US012788057B2

(12) United States Patent
Hupkes

(10) Patent No.: US 12,788,057 B2
(45) Date of Patent: Nov. 10, 2026

(54) AEROSOL GENERATION DEVICE, METHOD FOR MANUFACTURING

(71) Applicant: JT International S.A., Geneva (CH)

(72) Inventor: Ernst Hupkes, Kampen (NL)

(73) Assignee: JT International SA, Geneva (CH)

( * ) Notice: Subject to any disclaimer, the term of this patent is extended or adjusted under 35 U.S.C. 154(b) by 1298 days.

(21) Appl. No.: 17/630,318

(22) PCT Filed: Aug. 7, 2020

(86) PCT No.: PCT/EP2020/072308
§ 371 (c)(1),
(2) Date: Jan. 26, 2022

(87) PCT Pub. No.: WO2021/023881
PCT Pub. Date: Feb. 11, 2021

(65) Prior Publication Data

US 2022/0248762 A1 Aug. 11, 2022

(30) Foreign Application Priority Data

Aug. 8, 2019 (EP) ..... 19190863

(51) Int. Cl.
*A24F 40/40* (2020.01)
*A24F 40/20* (2020.01)
(Continued)

(52) U.S. Cl.
CPC ..... *A24F 40/40* (2020.01); *A24F 40/20* (2020.01); *A24F 40/46* (2020.01); *A24F 40/50* (2020.01); *A24F 40/70* (2020.01)

(58) Field of Classification Search
CPC ..... A24F 40/10; A24F 40/20; A24F 40/50; A24F 40/40; A24F 40/70
See application file for complete search history.

(56) References Cited

U.S. PATENT DOCUMENTS 9,907,339 B2 * 3/2018 Liu ..... B65D 15/02
9,943,110 B2 * 4/2018 Liu ..... A24F 40/40
(Continued)

FOREIGN PATENT DOCUMENTS

CA 2852318 A1 3/2015
CN 105792686 A 7/2016
(Continued)

OTHER PUBLICATIONS

CN109480337 translation (Year: 2019).*
(Continued)

*Primary Examiner* — Marcus E Harcum
(74) *Attorney, Agent, or Firm* — Lerner David LLP

(57) ABSTRACT

A method for manufacturing an aerosol generation device includes forming an intermediate sub-assembly by fixing a heater sub-assembly against a power-and-control sub-assembly, the heater sub-assembly including a heater and a heating chamber wherein the heater is arranged in the heater sub-assembly to supply heat to the heating chamber, and the power-and-control sub-assembly including an electrical power source and control circuitry configured to control the supply of electrical power from the electrical power source to the heater; attaching an access sub-assembly to the intermediate sub-assembly, the access sub-assembly including means for opening and closing access to the heating chamber; and attaching a housing sub-assembly to the intermediate sub-assembly, the housing sub-assembly including a housing for at least a part of the intermediate sub-assembly. Also provided is a power-and-control sub-assembly, a sub-assembly including a heater sub-assembly fixed against a power-and-control sub-assembly, and an aerosol generation device.

19 Claims, 15 Drawing Sheets

(51) Int. Cl.

| | |
|---|---|
| ***A24F 40/46*** | (2020.01) |
| ***A24F 40/50*** | (2020.01) |
| ***A24F 40/70*** | (2020.01) |

(56) References Cited

U.S. PATENT DOCUMENTS

| | | | | |
|---|---|---|---|---|
| 10,058,122 | B2 * | 8/2018 | Steingraber | A24F 40/60 |
| 10,058,125 | B2 * | 8/2018 | Worm | A61M 11/042 |
| 10,383,367 | B2 * | 8/2019 | Rasmussen | H05B 1/0297 |
| 10,888,125 | B2 * | 1/2021 | Anderson | H01R 13/6205 |
| 11,316,213 | B2 * | 4/2022 | Gratton | A24F 40/40 |
| 11,588,287 | B2 * | 2/2023 | Novak, III | A24F 40/485 |
| 12,133,556 | B2 * | 11/2024 | Chan | A24F 40/465 |
| 12,268,240 | B2 * | 4/2025 | Thorsen | H05B 3/565 |
| 2014/0130796 | A1 * | 5/2014 | Liu | A24F 40/44 128/202.21 |
| 2015/0245668 | A1 * | 9/2015 | Memari | A24F 40/95 206/250 |
| 2017/0064999 | A1 * | 3/2017 | Perez | A24F 40/40 |
| 2017/0099877 | A1 * | 4/2017 | Worm | A24F 40/40 |
| 2017/0181471 | A1 * | 6/2017 | Phillips | A24F 40/70 |
| 2017/0215478 | A1 * | 8/2017 | Harrison | A24F 40/485 |
| 2018/0310628 | A1 | 11/2018 | Qiu | |
| 2018/0338541 | A1 | 11/2018 | Worm et al. | |
| 2019/0166914 | A1 * | 6/2019 | Qiu | A24F 40/40 |
| 2019/0174827 | A1 * | 6/2019 | Fernando | H01R 13/2421 |
| 2019/0191764 | A1 * | 6/2019 | Lin | A24F 40/40 |
| 2019/0200678 | A1 | 7/2019 | Thorson et al. | |
| 2019/0373679 | A1 * | 12/2019 | Fu | A24F 40/40 |
| 2020/0008478 | A1 * | 1/2020 | Ouyang | H05B 3/06 |
| 2020/0236995 | A1 * | 7/2020 | Zhou | A24F 40/51 |
| 2020/0359695 | A1 | 11/2020 | Lim | |
| 2021/0030980 | A1 * | 2/2021 | Liu | H05B 1/0227 |
| 2021/0112858 | A1 * | 4/2021 | Liu | A24F 40/485 |
| 2022/0346447 | A1 | 11/2022 | Hupkes | |
| 2024/0408328 | A1 * | 12/2024 | Brammer | A24F 40/50 |

FOREIGN PATENT DOCUMENTS

| | | | | | |
|---|---|---|---|---|---|
| CN | 108882751 | A | | 11/2018 | |
| CN | 109480337 | A | * | 3/2019 | A24F 47/008 |
| CN | 208875414 | U | | 5/2019 | |
| CN | 114080165 | A | | 2/2022 | |
| EP | 2835063 | A1 | | 2/2015 | |
| JP | 2019518421 | A | | 7/2019 | |
| WO | 2015035510 | A1 | | 3/2015 | |
| WO | WO-2017143495 | A1 | * | 8/2017 | A24F 40/485 |
| WO | 2017194766 | A1 | | 11/2017 | |
| WO | 2018114849 | A1 | | 6/2018 | |
| WO | 2019047758 | A1 | | 3/2019 | |
| WO | 2019080745 | A1 | | 5/2019 | |
| WO | 2019088559 | A2 | | 5/2019 | |

OTHER PUBLICATIONS

Search Report dated Mar. 1, 2024 from the Office Action for Chinese Application No. 202080050788.0 issued Mar. 6, 2024, pp. 1-3.

Search Report dated Nov. 14, 2023 from the Office Action for Taiwanese Application No. 109126906, 2 pages.

Communication pursuant to Article 94(3) EPC, for Application No. 20751163.5, dated Jun. 4, 2024, pp. 1-5.

International Search Report for PCT/EP2020/072308 dated Oct. 5, 2020. 5 pgs.

* cited by examiner

AEROSOL GENERATION DEVICE, METHOD FOR MANUFACTURING

CROSS-REFERENCE TO RELATED APPLICATIONS

The present application is a national phase entry under 35 U.S.C. § 371 of International Application No. PCT/EP2020/072308, filed Aug. 7, 2020, published in English, which claims priority to European Application No. 19190863.1 filed Aug. 8, 2019, the disclosures of which are incorporated herein by reference.

FIELD OF THE DISCLOSURE

The present disclosure relates to an aerosol generation device and to a method for manufacturing such a device. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND TO THE DISCLOSURE

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 300° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aersolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

Such devices are commonly mass-produced, and therefore it is desirable to provide a device which can be assembled as easily as possible while meeting the requirements of a robust construction which is safe and reliable for the user.

SUMMARY OF THE DISCLOSURE

According to a first aspect of the disclosure, there is provided a method for manufacturing an aerosol generation device, the method comprising: forming an intermediate sub-assembly by fixing a heater sub-assembly against a power-and-control sub-assembly, the heater sub-assembly comprising a heater and a heating chamber wherein the heater is arranged in the heater sub-assembly to supply heat to or in the heating chamber, and the power-and-control sub-assembly comprising an electrical power source and control circuitry configured to control the supply of electrical power from the electrical power source to the heater; and attaching a housing sub-assembly to the intermediate sub-assembly, the housing sub-assembly comprising a housing for at least a part of the intermediate sub-assembly.

Optionally, the method comprises forming the power-and-control sub-assembly by: aligning a heater sub-assembly support frame and an electrical power source support frame with a first PCB therebetween, the first PCB having a component of the control circuitry mounted thereon; and attaching the heater sub-assembly support frame to the electrical power source support frame.

Optionally, the first PCB is connected to a second PCB by a flexible PCB portion, and forming the power-and-control sub-assembly further comprises wrapping the flexible PCB portion around the heater sub-assembly support frame and attaching the second PCB to the heater sub-assembly support frame such that the heater sub-assembly support frame is between the first PCB and the second PCB.

Optionally, two or more of the heater sub-assembly support frame, the electrical power source support frame and the first PCB each comprise first guide members, and aligning the heater sub-assembly support frame and the electrical power source support frame with the first PCB therebetween comprises aligning the first guide members.

Optionally, forming the power-and-control sub-assembly using only snap-fit or press-fit mechanical connections.

Optionally, the heater sub-assembly and the power-and-control sub-assembly each comprise second guide members, and fixing the heater sub-assembly against the power-and-control sub-assembly comprises aligning the second guide members.

Optionally, fixing the heater sub-assembly against the power-and-control sub-assembly comprises attaching a mounting cap to one or both of the heater sub-assembly and the power-and-control sub-assembly, and wherein the heater sub-assembly, the power-and-control sub-assembly and the mounting cap are adapted to interlock with each other such that, when the mounting cap is attached to the one or both of the heater sub-assembly and the power-and control sub-assembly, the heater sub-assembly is fixed against the power-and-control sub-assembly.

Optionally, attaching the housing sub-assembly to the intermediate sub-assembly consists only of using an attachment means to attach a point on the housing to a point on the intermediate sub-assembly.

Optionally, the attachment means is a fastening means.

Optionally, the fastening means is a screw.

Optionally, the method further comprises attaching an access sub-assembly to the intermediate sub-assembly, the access sub-assembly comprising means for opening and closing access to the heating chamber.

Optionally, the access sub-assembly and the intermediate sub-assembly are adapted to form one or more snap-fit or press-fit connections with each other.

According to a second aspect of the disclosure, there is provided a sub-assembly for manufacturing an aerosol generation device, the sub-assembly comprising a heater sub-assembly fixed against a power-and-control sub-assembly, wherein the power-and-control sub-assembly comprises an electrical power source and control circuitry configured to control the supply of electrical power from the electrical power source to a heater, the heater sub-assembly comprises the heater and a heating chamber, and the heater is arranged in the heater sub-assembly to supply heat to or in the heating chamber.

Optionally, the power-and-control sub-assembly comprises a heater sub-assembly support frame attached to an electrical power source support frame with a first PCB therebetween, the first PCB having a component of the control circuitry mounted thereon.

Optionally, the first PCB is connected to a second PCB by a flexible PCB portion, the flexible PCB portion is wrapped around the heater sub-assembly support frame, and the second PCB is attached to the heater sub-assembly support frame such that the heater sub-assembly support frame is between the first PCB and the second PCB.

Optionally, the control circuitry comprises a PCB having exposed electrical contacts for testing and/or for connection to the heater sub-assembly.

Optionally, the sub-assembly further comprises a mounting cap attached to one or both of the heater sub-assembly and the power-and-control sub-assembly, wherein the heater sub-assembly, the power-and-control sub-assembly and the mounting cap are adapted to interlock with each other such that the heater sub-assembly is fixed against the power-and-control sub-assembly.

According to a third aspect of the disclosure, there is provided an aerosol generation device comprising the sub-assembly as described above as an intermediate sub-assembly, and further comprising a housing sub-assembly comprising a housing for at least a part of the intermediate sub-assembly, wherein the housing sub-assembly is attached to the intermediate sub-assembly.

Optionally, the aerosol generation device further comprises an access sub-assembly comprising means for opening and closing access to the heating chamber, wherein the access sub-assembly is attached to the intermediate sub-assembly; and Optionally, where the intermediate sub-assembly comprises a mounting cap, the access sub-assembly is only attached to the mounting cap.

According to a fourth aspect of the disclosure, there is provided an aerosol generation device comprising an electrical power source; a heating chamber; a heater arranged to supply heat to the heating chamber; control circuitry configured to control the supply of electrical power from the electrical power source to the heater; a frame; and a housing having an internal volume containing the electrical power source, the heating chamber, the heater, the control circuitry and the frame, wherein the control circuitry comprises at least a first PCB that is arranged along the frame and a second PCB, the first PCB and second PCB being connected by a flexible PCB portion and the first and second PCBs being arranged along the frame in two different planes.

Optionally, the second PCB is also arranged along the frame.

Optionally, the second PCB is parallel or perpendicular to the first PCB.

Optionally, the control circuitry comprises a third PCB arranged along the frame and connected to the first PCB by a second flexible PCB portion.

DETAILED DESCRIPTION

Figure 1A:
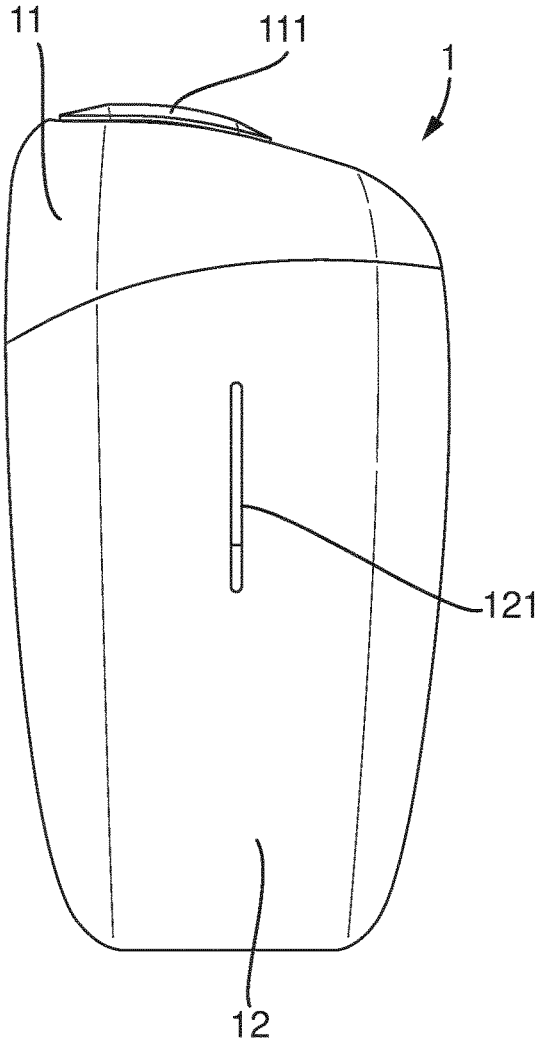
FIGS. 1A and 1B are schematic views of an aerosol generation device.
Figure 1B:
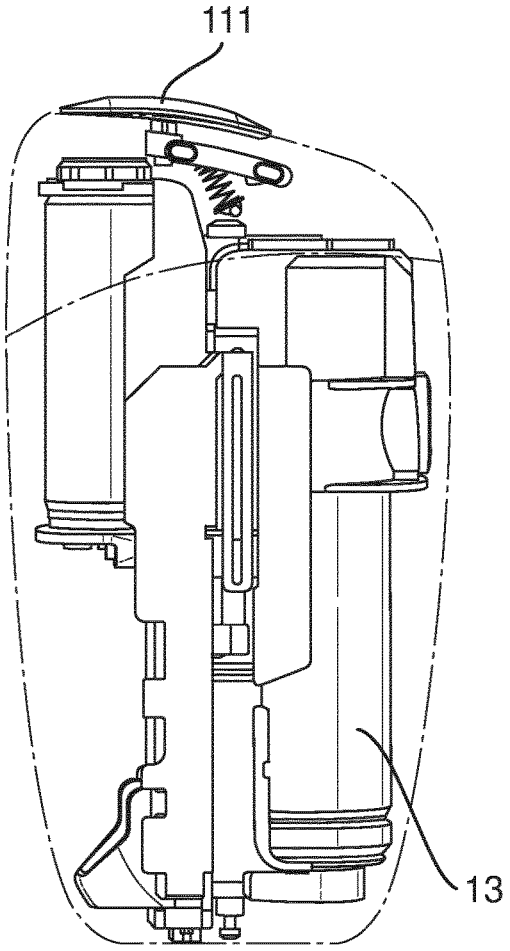
Figure 2:
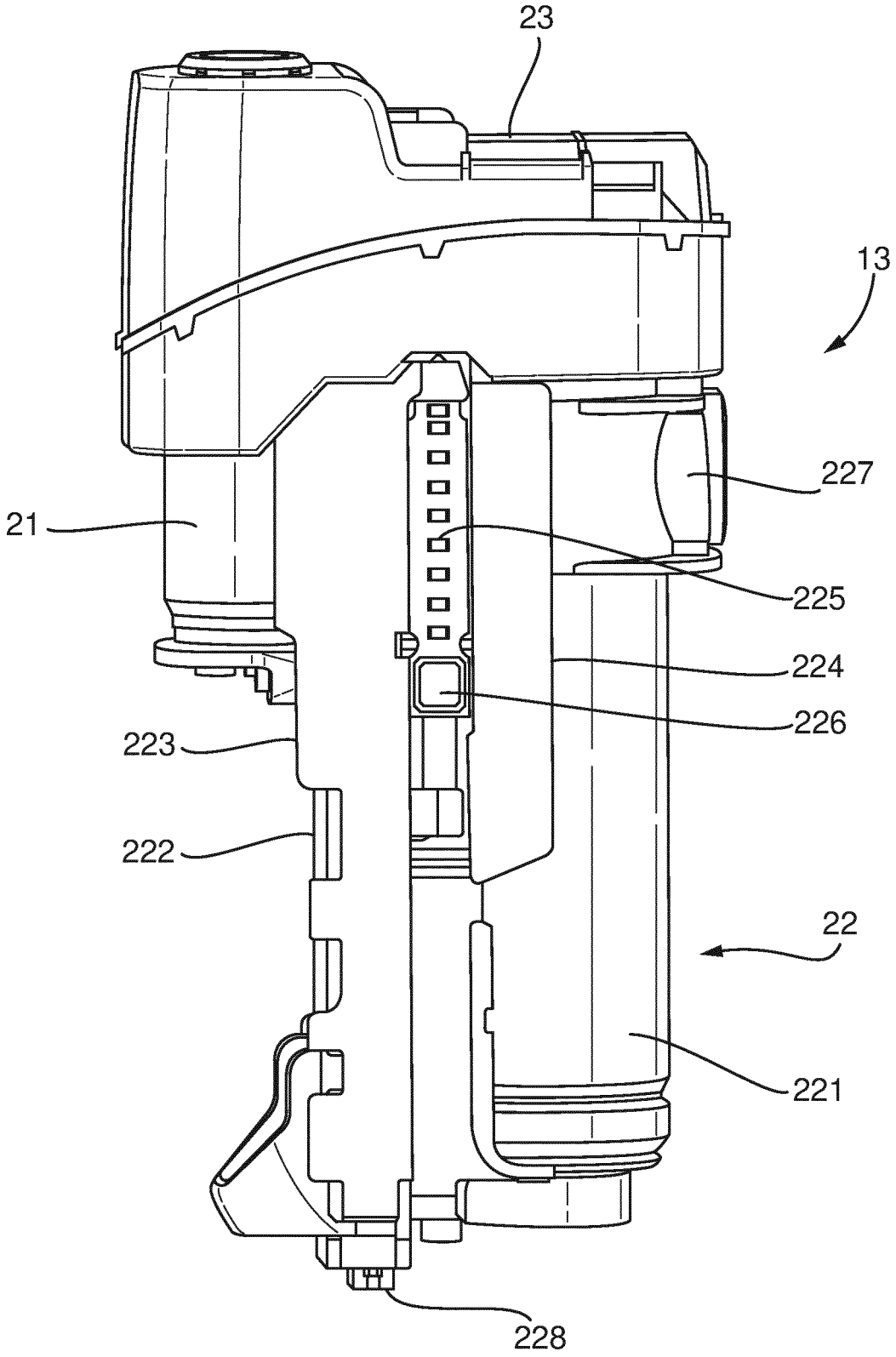
FIG. 2 is a schematic view of an intermediate sub-assembly.

As an overview of the aerosol generation device to be manufactured according to an embodiment of the invention, FIGS. 1A, 1B and 2 illustrate a series of modular sub-assemblies which are assembled in the aerosol generation device. FIGS. 3A to 10D illustrate additional details of each of the sub-assemblies, as well as stages of manufacturing the aerosol generation device. It should be understood that many details of the embodiment are not relevant for explaining the claimed method of manufacturing, and thus, for conciseness some features shown in the figures are not described in detail, and, for simplicity, some features are removed entirely in certain figures in order to better illustrate the features relevant for understanding and implementing the invention.

Referring to FIG. 1A, according to an embodiment of the invention, an aerosol generation device 1 comprises an access sub-assembly 11 and a housing sub-assembly 12.

The aerosol generation device 1 has an overall elongate and pebble-like shape, with a top end at which an aerosol is provided, a bottom end opposed to the top end, and four sides between the bottom end and the top end in a substantially quadrilateral arrangement of two larger opposing sides and two smaller opposing sides.

The access sub-assembly 11 is at the top end and comprises means for opening and closing access to a heating chamber inside the aerosol generation device 1, in order for a user to, for example, supply an aerosol substrate such as tobacco to be heated in the heating chamber, obtain the generated aerosol and clean the heating chamber. In this embodiment, the access means has a lid 111 attached to a slider mechanism.

The housing sub-assembly 12 provides a housing for internal components of the aerosol generation device 1, and provides at least part of the sides and bottom end of the aerosol generation device 1. Additionally, as illustrated in a central linear region 121 of the housing sub-assembly 12 of FIG. 1A, in this embodiment, the aerosol generation device 1 includes one or more indicators (e.g. lights) and one or more inputs (e.g. buttons) for controlling the aerosol generation device. In embodiments with indicator(s) or input(s), the housing sub-assembly may comprise a translucent part or a tactile part, or may simply comprise a gap allowing access to internal indicator(s) and input(s).

Referring to FIG. 1B, in this schematic view, the access sub-assembly 11 and housing sub-assembly 12 are represented as "transparent" (illustrated with dashed line edges) and it can be seen that the aerosol generation device 1 further comprises an intermediate sub-assembly 13 housed within the access sub-assembly 11 and the housing sub-assembly 12. Details of the intermediate sub-assembly 13 are shown in FIG. 2.

Referring to FIG. 2, the intermediate sub-assembly 13 comprises a heater sub-assembly 21 fixed against a power-and-control sub-assembly 22.

The heater sub-assembly 21 comprises a heater and a heating chamber, where the heater is arranged in the heater sub-assembly to supply heat to the heating chamber. The heater sub-assembly is described in more detail below by reference to FIG. 5.

The power-and-control sub-assembly 22 comprises an electrical power source 221, in this case a battery. The power-and-control sub-assembly 22 further comprises control circuitry 222 configured to control the supply of electrical power from the electrical power source to the heater. In this embodiment, the control circuitry 222 is mounted on a plurality of PCBs as described below.

The electrical power source 221 and the control circuitry 222 are supported by a heater sub-assembly support frame 223 and an electrical power source support frame 224. The heater sub-assembly support frame 223 is optionally made of a thermally insulating material in order to insulate the control circuitry 222 and the electrical power source 221 from the heater sub-assembly 21. The heater sub-assembly support frame 223 and electrical power source support frame 224 may, for example, comprise PA (Polyamide) and/or PEEK (Polyether ether ketone). The heater sub-assembly support frame 223 and the electrical power source support frame 224 may be regarded together in the aerosol generation device 1 as a frame.

As additionally, shown in FIG. 2, the power-and-control sub-assembly 22 may comprise an indicator array 225 of one or more indicators (e.g. LEDs) for indicating a state of the device and one or more inputs 226 (e.g. tactile switches) corresponding to the central linear region 121 of the housing sub-assembly 12 of FIG. 1A. The power-and-control sub-assembly 22 may further comprise a vibrator sub-assembly 227 to provide a further indication of the state of the device. Furthermore, the power-and-control sub-assembly 22 may comprise an external electrical connector 228 for charging the electrical power source 221 and optionally also for communicating data to or from the control circuitry 222.

There will now be described a method for manufacturing the aerosol generation device 1 as described above. As the skilled reader will recognise, many of the steps of the method are independent of each other and can be rearranged freely.

Figure 3A:
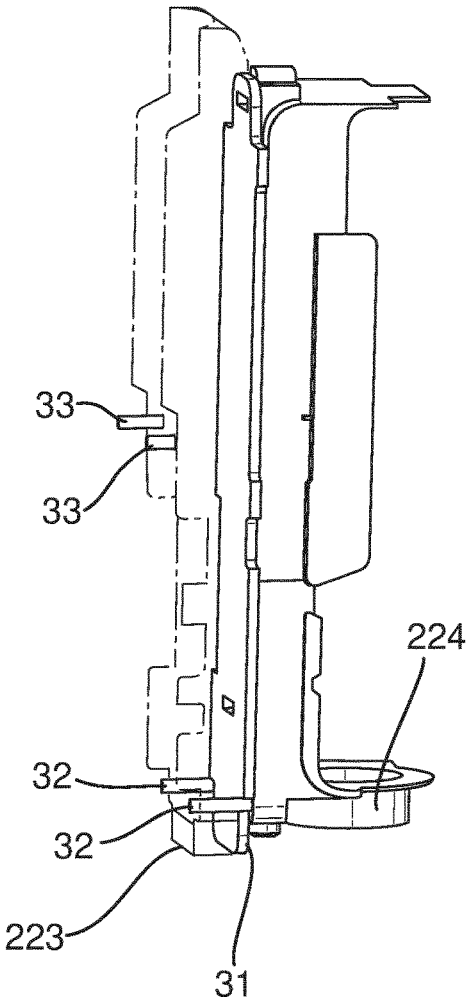
FIGS. 3A and 3B are schematic views of one stage in a method of manufacturing an aerosol generation device.
Figure 3B:
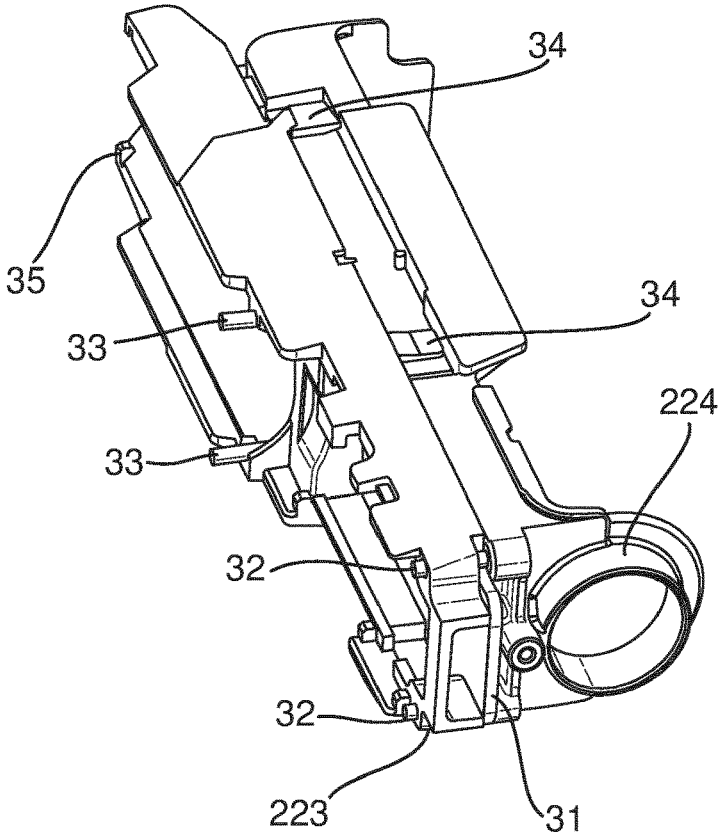

Referring to FIGS. 3A and 3B, a stage of assembling the power-and-control sub-assembly is shown. In the view of FIG. 3A, the heater sub-assembly support frame 223 is represented as "transparent" using dashed lines, so that a first PCB 31 can be seen between the two frames. On the other hand, FIG. 3B gives a solid view showing that the first PCB 31 is partly enclosed between the heater sub-assembly support frame 223 and the electrical power source support frame 224. In this embodiment, the power-and-control sub-assembly 22 is formed by aligning the heater sub-assembly support frame 223 and the electrical power source support frame 224 on either side of the first PCB 31, and attaching the heater sub-assembly support frame 223 to the electrical power source support frame 224.

The first PCB 31 has at least one component of the control circuitry 222 mounted on its substrate. For example, the first PCB 31 may include a processor chip or a memory chip.

To assist in aligning the heater sub-assembly support frame 223 and the electrical power source support frame 224, in this embodiment, the heater sub-assembly support frame 223 and the electrical power source support frame 224 include respective first guide members 32 and 32' which fit together when the frames are correctly aligned. For example, the first guide members 32 and 32' may be protrusions or pins, and corresponding recesses or holes. In other embodiments, additionally or instead, the first PCB 31 may have first guide members for aligning the first PCB 31 with respective first guide members of the heater sub-assembly support frame 223 and/or the electrical power source support frame.

To assist in aligning the power-and-control sub-assembly 22 with the heater sub-assembly 21, the heater sub-assembly support frame also includes second guide members 33, 35 as discussed further later.

Additionally, in this embodiment, the power-and-control sub-assembly is formed using only snap-fit or press-fit mechanical connections between constituent parts. That is, the power-and-control sub-assembly 22 is mechanically constructed without additional separate parts for fixing such as screws. In particular, in the embodiment of FIGS. 3A and 3B, the heater sub-assembly support frame 223 includes snap fit connectors 34 configured to attach to the electrical power source support frame 224 when the frames have been aligned. Although, in this embodiment, mechanical connections are limited to snap-fit and press-fit connections, it should be noted that soldering may be used to ensure good electrical connections between the electrical power source 221 and the control circuitry 222. Furthermore, in other embodiments, glue may be used to further improve robustness beyond that achieved by snap-fit or press-fit connections. For example, glue may be used in order to attach the electrical power source 221 to the electrical power source support frame 224.

Figure 4A:
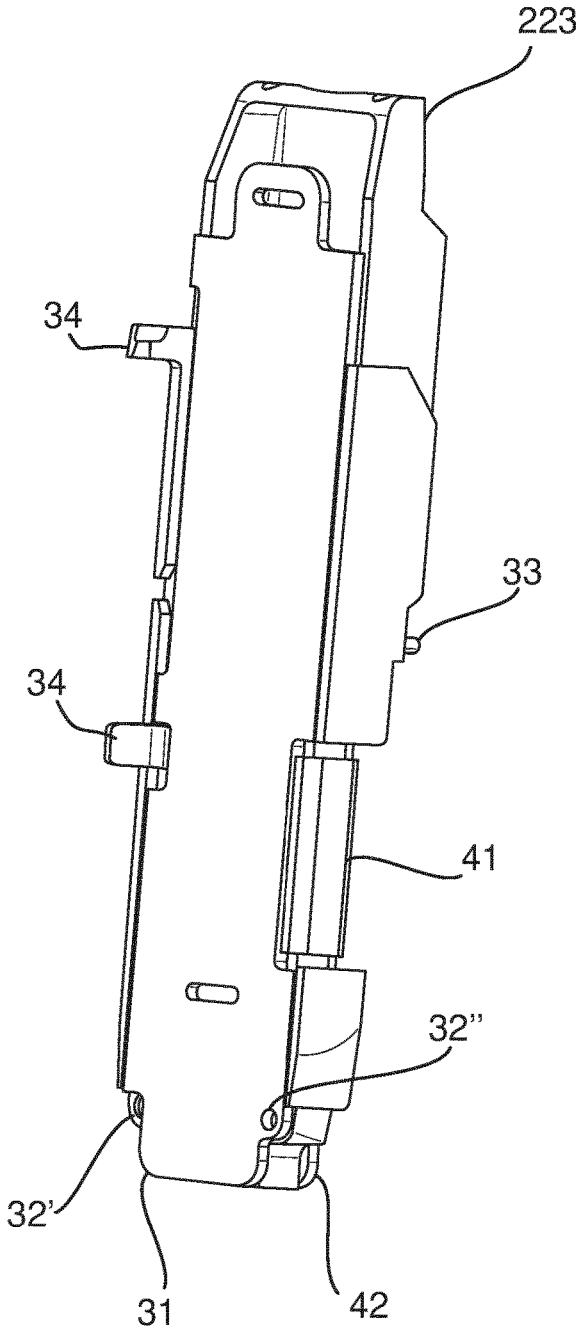
FIGS. 4A, 4B and 4C are schematic views of another stage in the method of manufacturing an aerosol generation device.
Figure 4B:
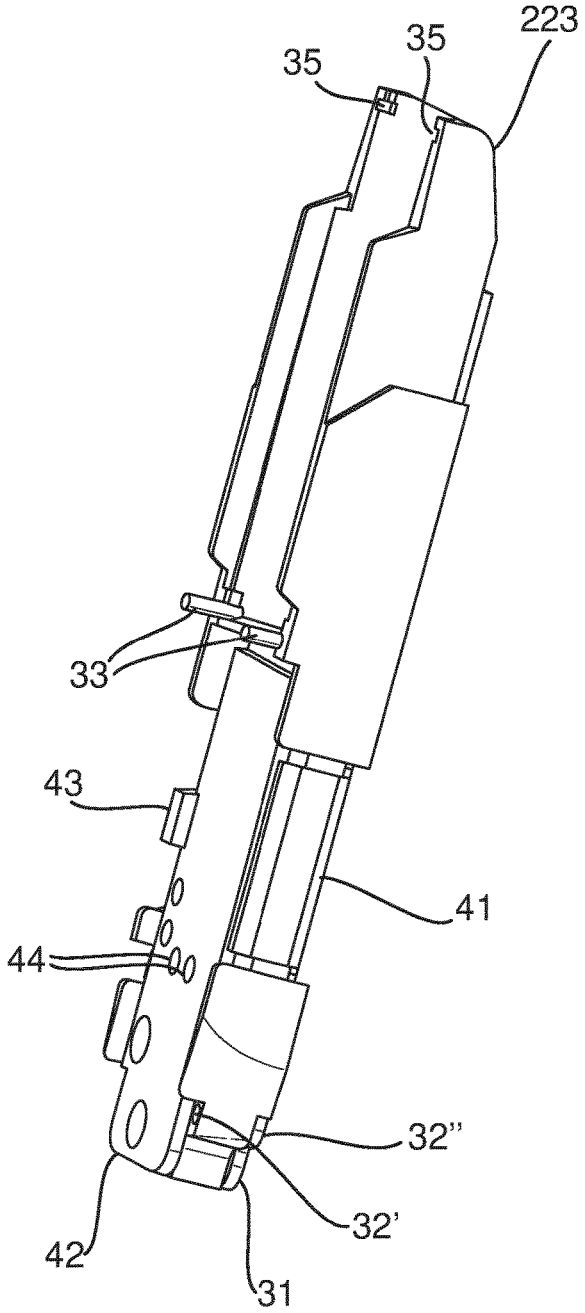
Figure 4C:
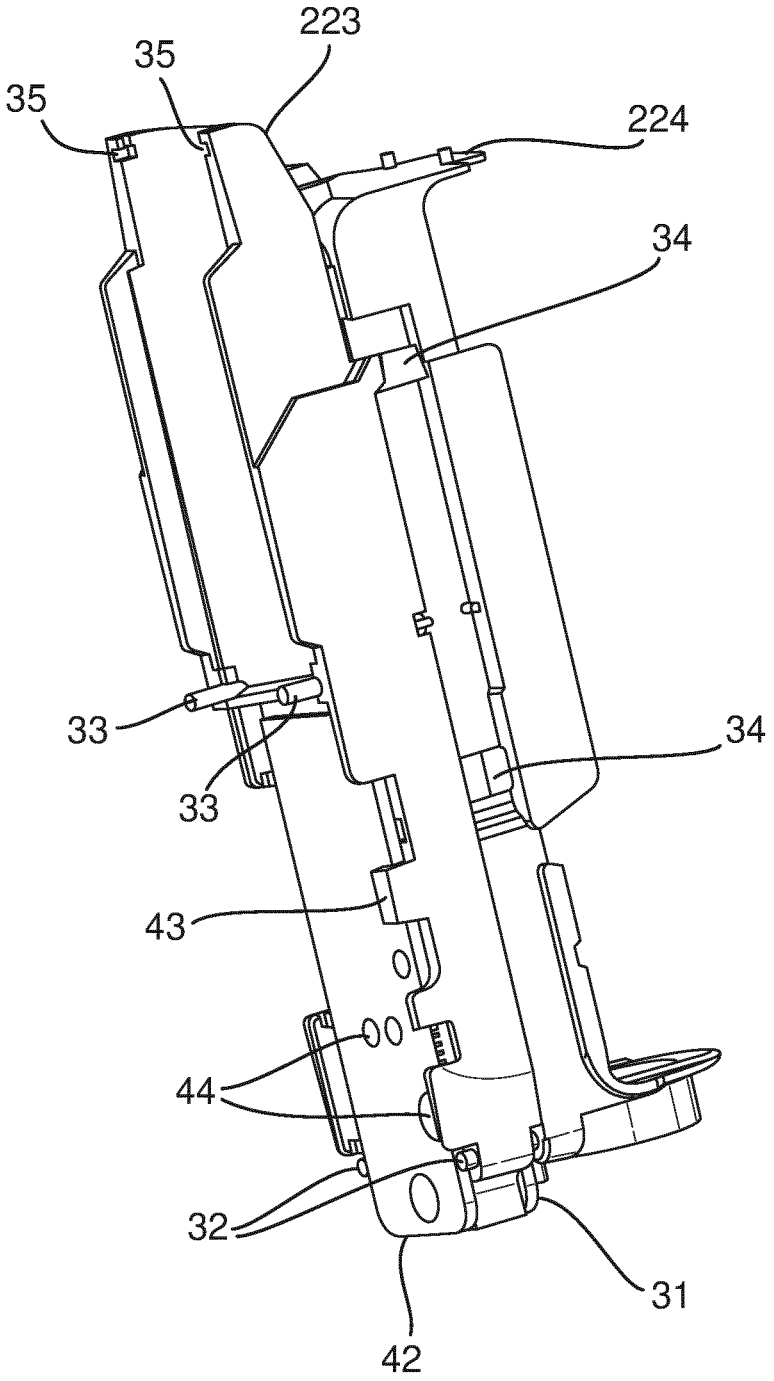

Referring to FIGS. 4A, 4B and 4C, another stage of assembling the power-and-control sub-assembly is shown from various viewpoints around the assembly. This stage may occur before or after the assembly described above with references to FIGS. 3A and 3B. As a reflection of this option, the electrical power source support frame 224 is shown in FIG. 4C but omitted in FIGS. 4A and 4B. In order to make sense of the comparison between these figures, it should be noted that FIG. 4B is horizontally reflected with respect to FIGS. 4A and 4C, in order to more effectively show a flexible PCB portion 41.

As shown in FIGS. 4A-C, the power-and-control sub-assembly 22 of this embodiment comprises a first PCB 31, a second PCB 42, and the flexible PCB portion 41, the first and second PCBs 31, 42 being connected to each other by the flexible PCB portion 41. The power-and-control sub-assembly 22 may comprise further PCBs in this embodiment, for example hosting the indicator array 225 and input 226 shown in FIG. 2, but these are less relevant for the method of the invention.

At this stage, forming the power-and-control sub-assembly 22 comprises wrapping the flexible PCB portion 41 around the heater sub-assembly support frame 223 and attaching the second PCB 42 to the heater sub-assembly support frame 223 such that the heater sub-assembly support frame 223 is between the first PCB 31 and the second PCB 42, and the first and second PCBs are arranged along the heater sub-assembly support frame 223 in two different planes. Additionally or alternatively, the second PCB may be arranged along the heater sub-assembly support frame 223. This usage of a flexible PCB portion not only means that, when one of the first and second PCBs 31, 42 is fixed, the other is easily guided into a correct position, but also means that a larger area for control circuitry 222 can be easily printed once and at the same time divided among multiple surfaces in order to fit the control circuitry 222 into an irregular space and reduce the space required for the control circuitry 222, and helps to reduce the volume of the aerosol generation device 1.

FIG. 4A also shows an example of a first guide member 32" in the first PCB 31, described above as an addition or alternative to first guide members 32 and 32' in the heater sub-assembly support frame 223 and the electrical power source support frame 224.

As shown in FIGS. 4B and 4C, the heater sub-assembly support frame 223 may comprise additional snap fit connectors 43 for attaching the second PCB 42 to the frame. Additionally, the second PCB 42 comprises electrical contacts 44 for testing and/or for connection to the heater sub-assembly 21. These contacts 44 remain exposed when the power-and-control sub-assembly 22 is complete, making it easier to test the power-and-control sub-assembly and to make electrical connections between the heater sub-assembly 21 and the power-and-control sub-assembly 22.

Figure 5A:
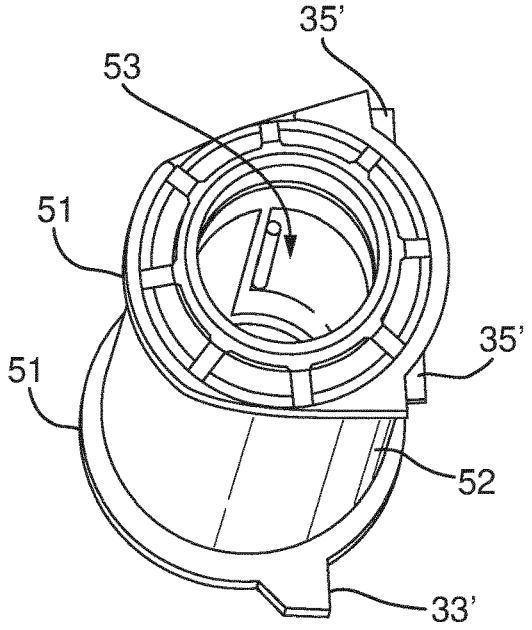
FIGS. 5A, 5B and 5C are schematic views of a heater sub-assembly.
Figure 5B:
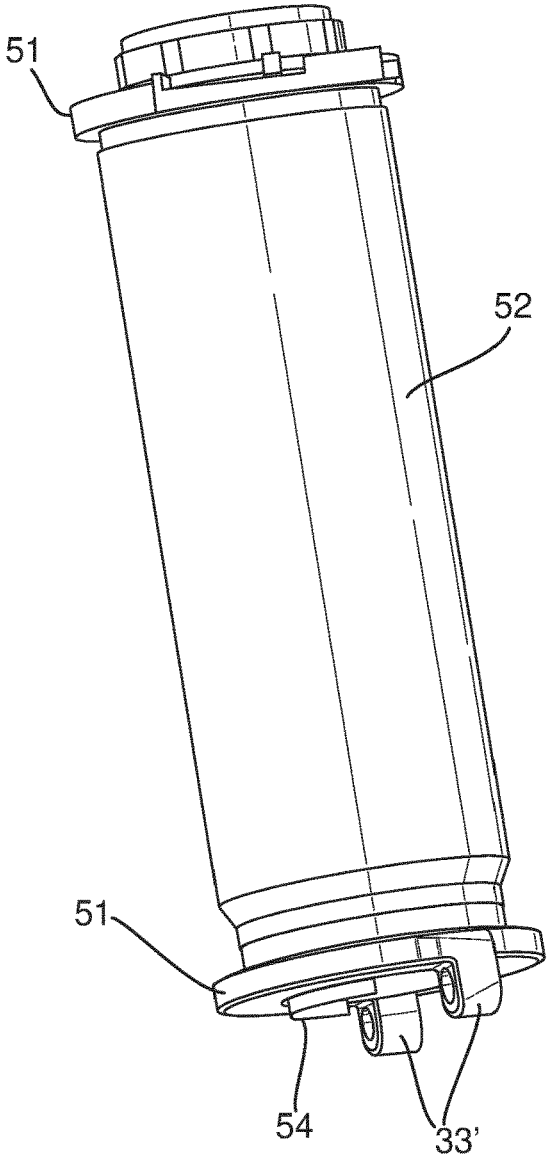
Figure 5C:
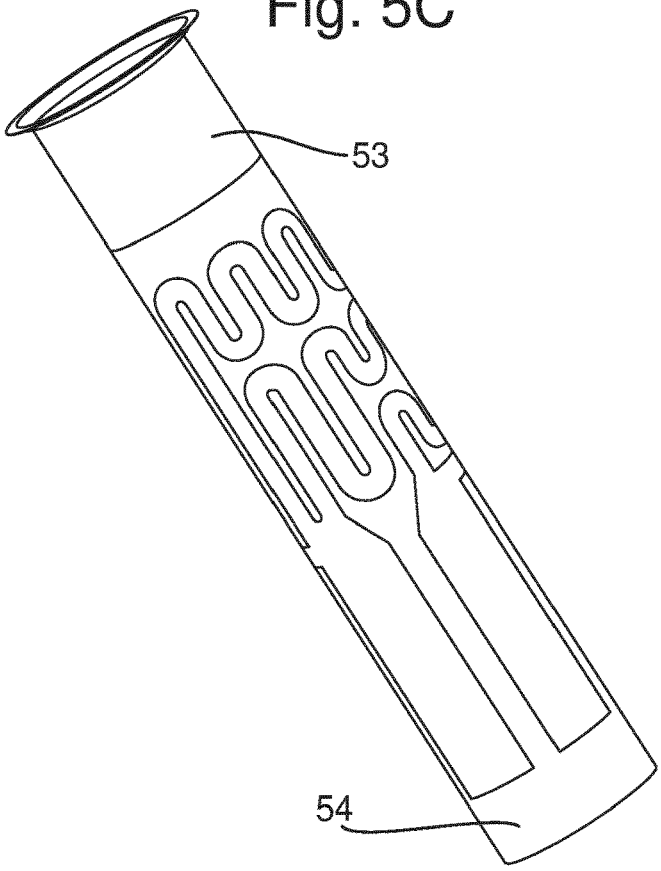

Turning to FIGS. 5A, 5B and 5C, before discussing how the intermediate sub-assembly 13 is formed by fixing the heater sub-assembly 21 against the power-and-control sub-assembly 22, some additional detail of the heater sub-assembly 21 is described.

FIGS. 5A and 5B are end and side views respectively of the complete heater sub-assembly 21. Referring to FIGS. 5A and 5B, a heater end frame 51 is provided at each end of the heater sub-assembly 21 for supporting, aligning and attaching the heater sub-assembly. The heater end frames 51 include respective second guide members 33' and 35' for assisting alignment between the heater sub-assembly 21 and the power-and-control sub-assembly 22.

Between the heater end frames 51, an insulating sheath 52 is provided. The insulating sheath 52 surrounds a heating chamber 53 and a heater 54 which are shown separately in FIG. 5C. The heating chamber is an elongate chamber open at one end corresponding to the access sub-assembly 11 and comprises a thermally conductive material, such as metal, in order to conduct heat from the heater 54 wrapped around the outside of the heating chamber 53 to an aerosol substrate material in the heating chamber 53. The insulating sheath 52 is provided to insulate and contain the heat generated by the heater 54 so that the heat is more efficiently delivered to a heating chamber 53 and so that other components of the aerosol generation device 1 are less exposed to heat from the heater 54. In this embodiment, the heater sub-assembly 21 further comprises a temperature sensor for measuring a temperature in the heater sub-assembly.

The heater 54 and the temperature sensor have electrical contacts or connections to receive a power supply and to obtain measurements respectively.

Figure 6A:
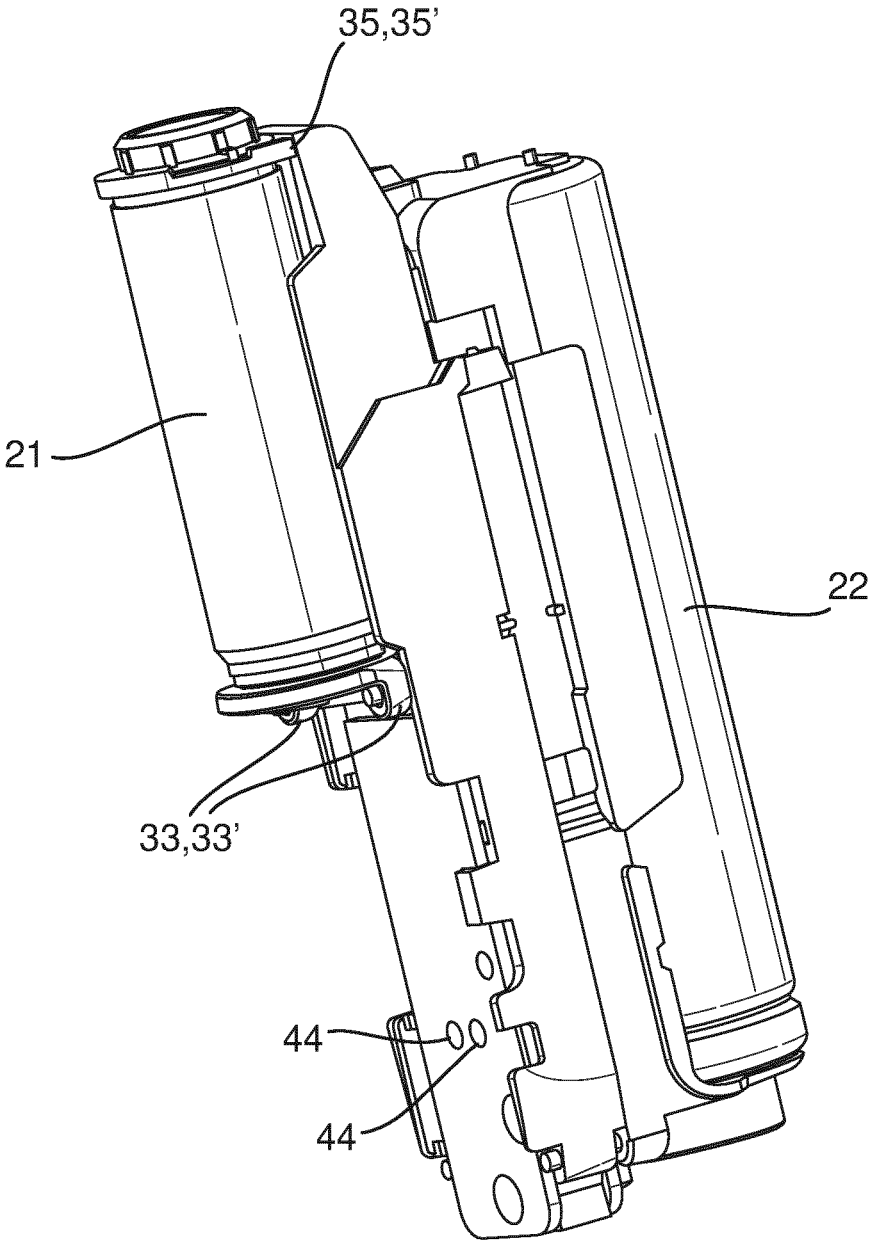
FIGS. 6A and 6B are schematic views of another stage in the method of manufacturing an aerosol generation device.
Figure 6B:
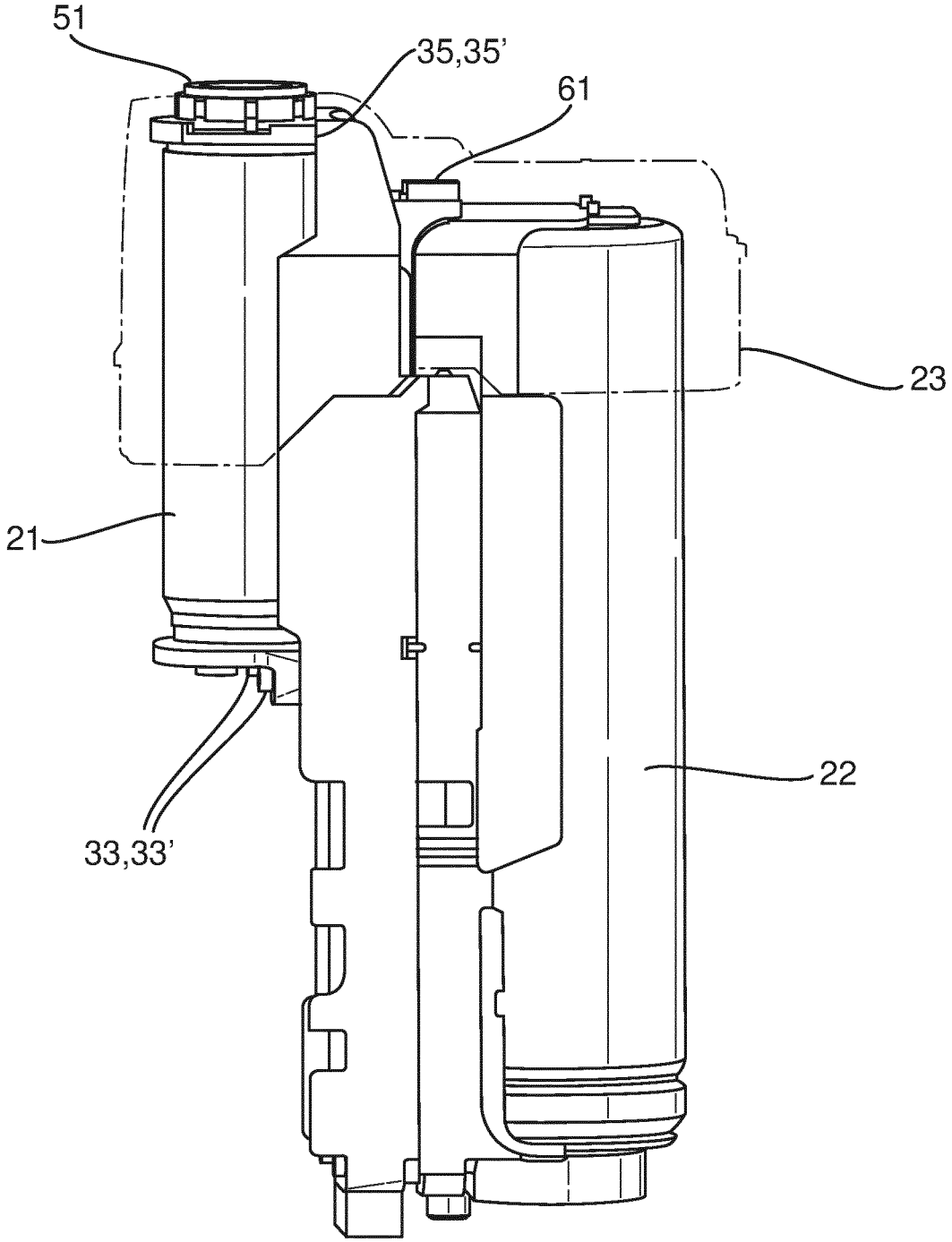

Referring to FIGS. 6A and 6B a sequence of method stages are shown for fixing the heater sub-assembly 21 against the power-and-control sub-assembly 22 to form the intermediate sub-assembly 13.

As shown in FIG. 6A, at a first stage, the respective second guide members 33, 33', 35 and 35' of the heater sub-assembly 21 and the power and control sub-assembly 22 are aligned and fitted together. As with the first guide members, the second guide members may be protrusions or pins, and corresponding recesses or holes. As a result of this aligning and fitting, the heater sub-assembly 21 and the power and control sub-assembly 22 are correctly positioned but are not yet attached.

As shown in FIG. 6B, at a second stage, a mounting cap 23 is arranged to fit over an end of the aligned heater sub-assembly 21 and power and control sub-assembly 22 in a longitudinal direction, at least partly covering the heater sub-assembly 21 and the power-and-control sub-assembly 22. The heater sub-assembly 21, the power-and-control sub-assembly 22 and the mounting cap 23 are adapted to interlock with each other such that, when the mounting cap 23 is arranged over the end, the heater sub-assembly 21 and power-and-control sub-assembly 22 are unable to separate from each other. In particular, in this embodiment, the mounting cap 23 is adapted to surround and partially cover the end of the aligned heater sub-assembly 21 and power-and-control sub-assembly 22 around the longitudinal direction, and the second guide members 33, 33', 35, 35' are arranged to prevent relative motion in the longitudinal direction between the heater sub-assembly 21 and the power-and-control sub-assembly 22 because this is transverse to the direction of the second guide members. Thus, by attaching the mounting cap 23 to one or both of the heater sub-assembly 21 and the power-and control sub-assembly 22, relative motion between the heater sub-assembly 21 and the power-and-control sub-assembly 22 is prevented both in the longitudinal direction, because this would be transverse to the direction of the second guide members, and around the longitudinal direction, because this would be either transverse to the direction of the second guide members or prevented by the covering and surrounding mounting cap. Thus, the heater sub-assembly 21 is fixed against the power-and-control sub-assembly 22.

In this embodiment, the mounting cap 23 is attached to the electrical power source support frame 224 of the power-and-control sub-assembly 22 at a mounting cap attachment point 61. Attachment may be performed using one or more reversible fastening means such as screws. By performing this attachment using a reversible fastening means, the heater sub-assembly 21 is more easily extracted for cleaning, although other embodiments use a a snap-fit or press-fit connection at the mounting cap attachment point 61.

It should be noted that the mounting cap 23 is not essential for fixing the heater sub-assembly 21 against the power-and-control sub-assembly 22, and, in other embodiments, such fixing may be performed by instead providing further snap-fit or press-fit connectors instead of or in addition to the second guide members 33, 33', 35, 35'. This alternative embodiment further reduces the number of components and steps required for manufacturing the aerosol generation device. Nevertheless, even if the mounting cap 23 is not used for fixing the heater sub-assembly 21 against the power-and-control sub-assembly 22, including the mounting cap 23 is advantageous for attaching the access sub-assembly 11 and the housing sub-assembly 12. In particular, the mounting cap 23 provides a modular attachment interface which is independent of the other components of the intermediate sub-assembly 13 and which can be adapted for convenient attachment to the device housing separately from any adaptation of the heater sub-assembly 21 and the power-and-control sub-assembly 22 for other purposes.

When the heater sub-assembly 21 has been fixed against the power-and-control sub-assembly 22 as shown in FIG. 6B, electrical connections such as wires can be easily installed between the heater sub-assembly 21 and the power-and-control sub-assembly 22 using the exposed electrical contacts 44 of the power-and-control sub-assembly 22 and the electrical contacts or connections of the heater 54 and the temperature sensor of the heater sub-assembly 21.

Figure 7A:
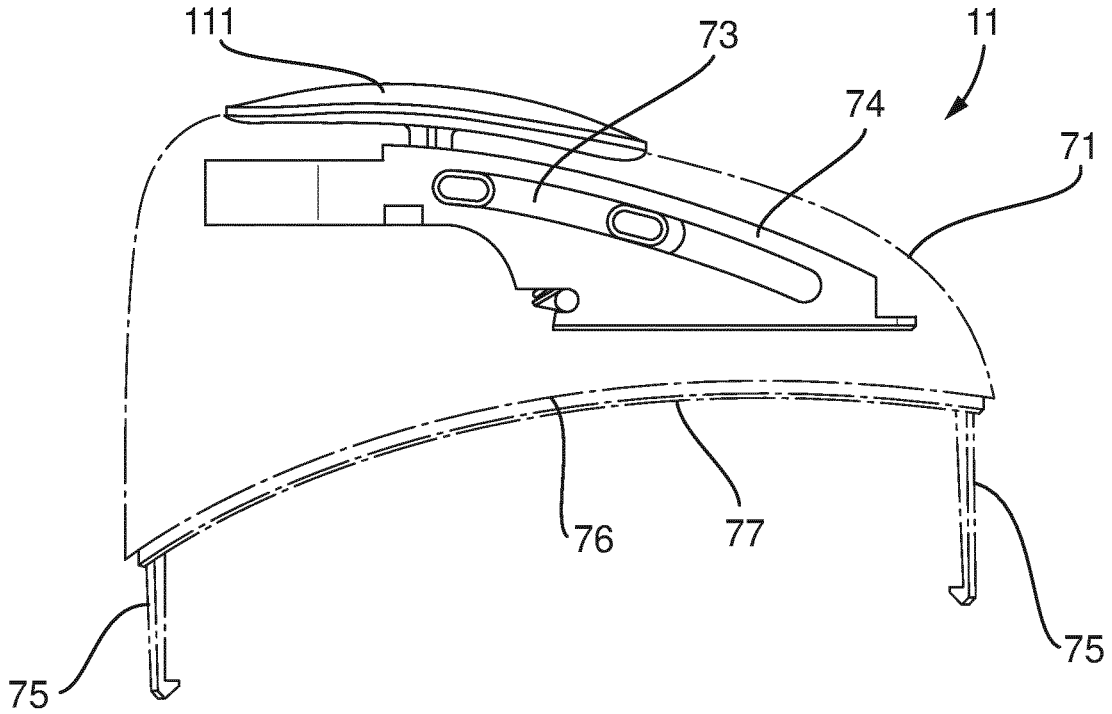
FIGS. 7A and 7B are schematic views of an access sub-assembly.
Figure 7B:
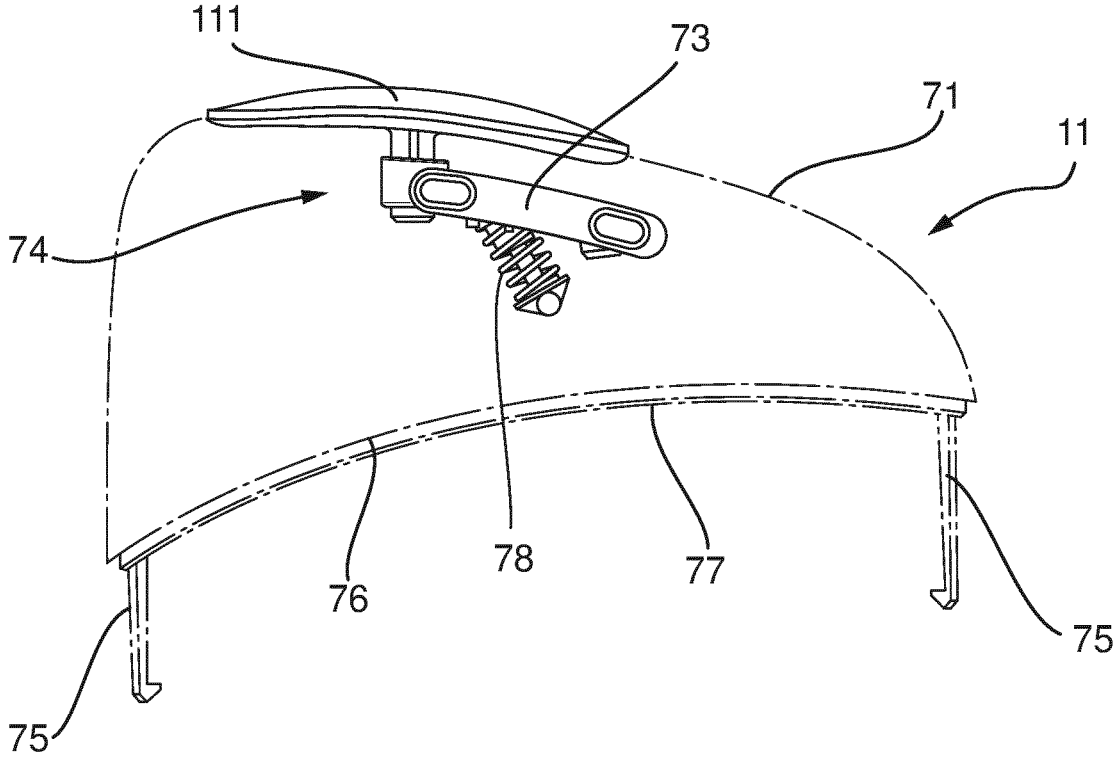

Turning to FIGS. 7A and 7B, before discussing how the access sub-assembly 11 is attached to the intermediate sub-assembly 13, some additional detail of the access sub-assembly 11 is described.

FIG. 7A shows a view of the access sub-assembly 11 where an access housing 71 is made "transparent" (indicated with dashed lines) so that internal features of the access sub-assembly 11 can be more easily seen.

The lid 111 is attached to a slider cart 73. The slider cart is arranged to slide along a slider guide 74, such that the lid 111 slides between an open position and a closed position. In the closed position, an opening in the access housing 71 is blocked by the lid 111. In the open position, the opening in the access housing 71 is opened. When the aerosol generation device 1 is assembled and the lid 111 is in the open position, the opening in the access housing 71 provides access to the heating chamber 53.

As shown in FIG. 7A, the access housing 71 includes snap-fit connectors 75 for attaching the access sub-assembly 11 to the intermediate sub-assembly 13. In this embodiment, two opposing snap-fit connectors 75 are provided corresponding to the two smaller opposing sides of the aerosol generation device 1, although any effective arrangement of connectors can be used. As with the previously-mentioned snap-fit connectors, the snap-fit connectors may alternatively be press-fit connectors.

Additionally, the access housing 71 includes a stepped rim along its bottom edge (as shown in the figure). An inner rim 77 extends downwards beyond an outer rim 76. As will be shown later, this stepped rim helps to secure the access sub-assembly 11 together with the housing sub-assembly 12, and can divert impact stress away from the snap-fit connectors 75 thereby helping to prevent a weak point in the structure at the join between the access sub-assembly 11 and the intermediate sub-assembly 13.

Turning to FIG. 7B, in this figure the slider guide 74 is hidden, providing a better view of a slider biasing mechanism 78 that acts to return the slider cart 73 and lid 111 to the closed position. This helps to ensure that the heating chamber 53 is covered when it is not in use.

Figure 8A:
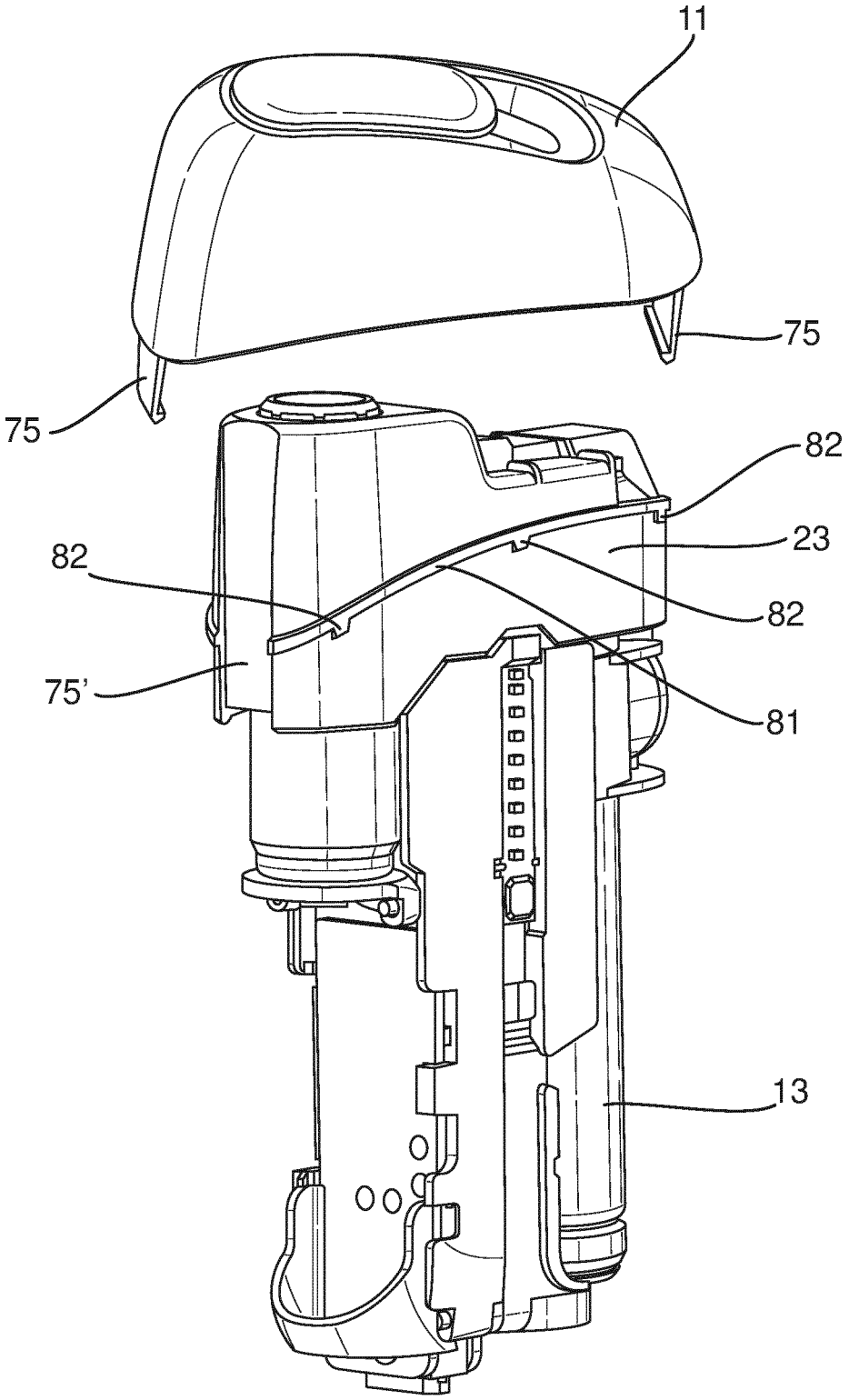
FIGS. 8A and 8B are schematic views of another stage in the method of manufacturing an aerosol generation device.
Figure 8B:
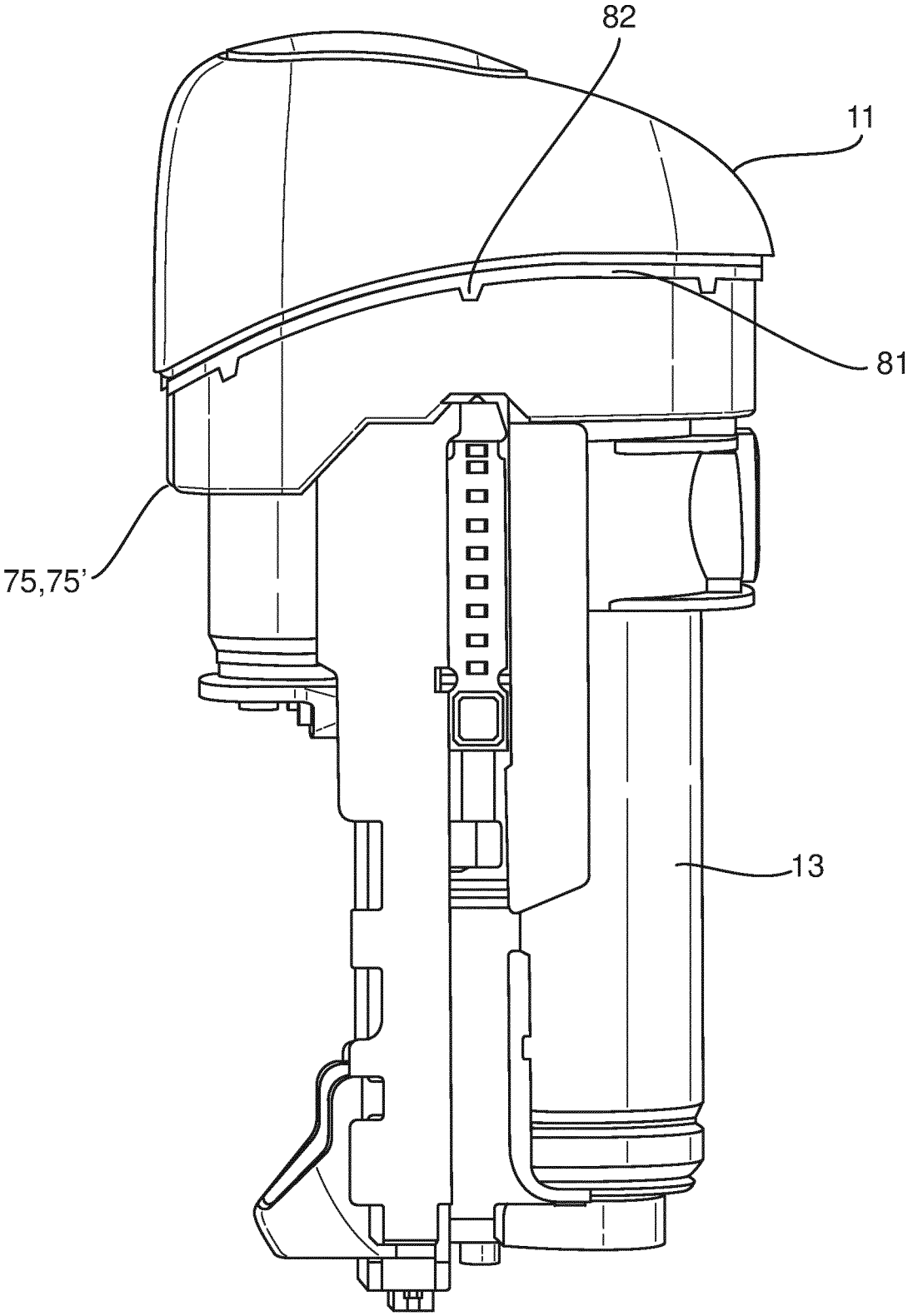

Referring now to FIGS. 8A and 8B, a method stage is shown of attaching the access sub-assembly 11 to the intermediate sub-assembly 13.

As shown in FIG. 8A, the mounting cap 23 of the intermediate sub-assembly 13 has an alignment ridge 81 adapted to fit against the outer rim 76 of the access sub-assembly 11 and has portions 75' adapted to connect with the snap-fit connectors 75 of the access sub-assembly. The combination of these features means that, when the access sub-assembly 11 is pushed onto the top of the intermediate sub-assembly 13, the access sub-assembly is automatically correctly positioned relative to, and attached to, the intermediate sub-assembly. Although the snap-fit connectors 75 extend downwards to the bottom of the mounting cap 23 in this embodiment, such an assembly method may be inhibited by the presence of the housing sub-assembly 12. Accordingly, in other embodiment, the snap fit connectors 75 and the complementary portions 75' are provided in a different configuration such that the access sub-assembly 11 may be attached to the intermediate sub-assembly 13 before or after attaching the housing sub-assembly 12.

FIG. 8B shows the combined access sub-assembly 11 and intermediate sub-assembly 13. As shown in FIG. 8B, the alignment ridge 81 is adapted to extend the inner rim 76 of the stepped rim shape of the access sub-assembly 11. Additionally, the mounting cap 23 comprises one or more third guide members 82 to assist in aligning the intermediate sub-assembly 13 with the housing sub-assembly 12, as described below. In this embodiment, the alignment ridge 81 and the third guide members 82 form a monolithic protrusion from the mounting cap 23, which reinforces the combined structure of the mounting cap and makes it easier to manufacture.

Figure 9A:
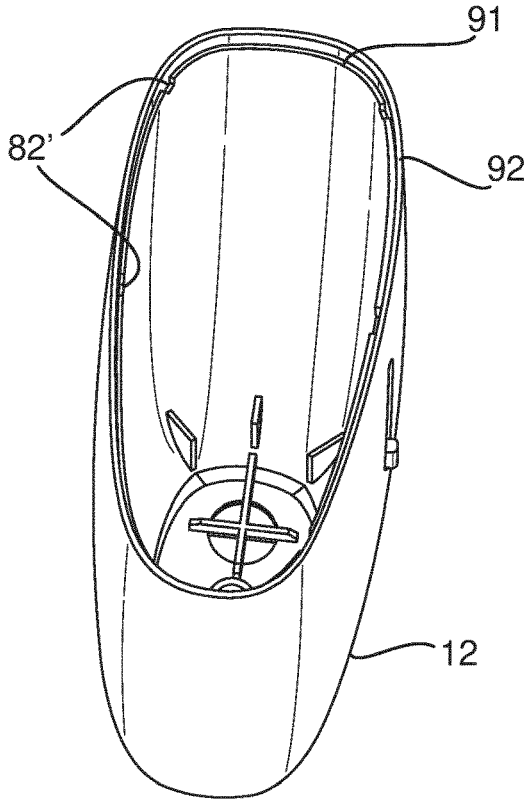
FIGS. 9A, 9B and 9C are schematic views of another stage in the method of manufacturing an aerosol generation device.
Figure 9B:
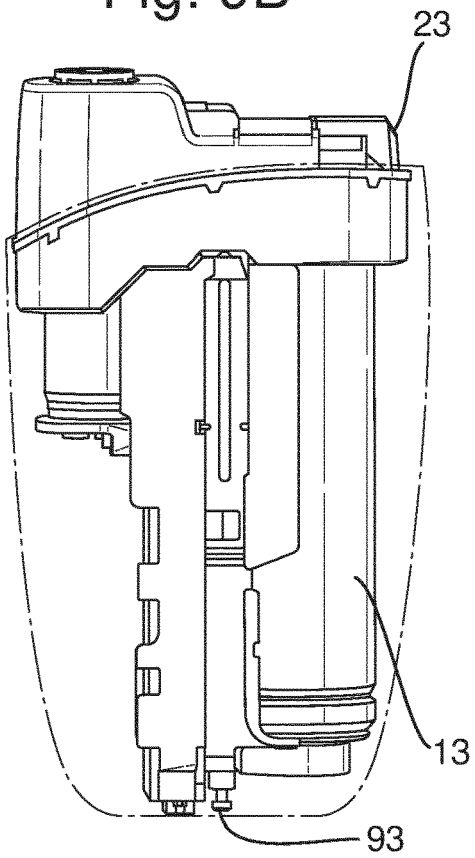
Figure 9C:
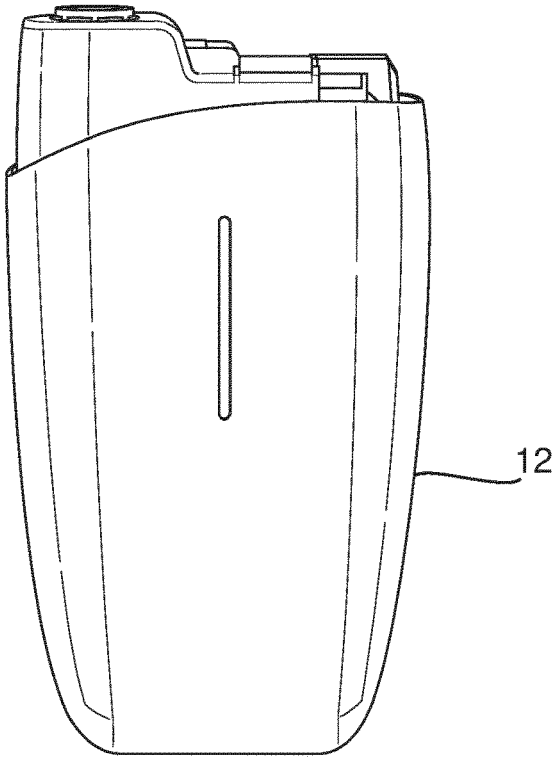

Referring now to FIGS. 9A, 9B and 9C, a method stage is shown of attaching the housing sub-assembly 12 to the intermediate sub-assembly 13. As mentioned above, in the example design of the snap-fit connectors 75, this stage must occur after attaching the access sub-assembly to the intermediate sub-assembly. However, in other embodiments, the order of attaching the access sub-assembly and the housing sub-assembly may be freely chosen. This is illustrated in FIGS. 9A, 9B and 9C by the omission of the access sub-assembly 11 for this method stage.

As shown in FIG. 9A, the housing sub-assembly 12 is substantially hollow in order to house at least a part of the intermediate sub-assembly 13. A rim around an open end of the housing sub-assembly 12 is stepped with an inner rim 91 and an outer rim 92 extending beyond the inner rim. This stepped rim is adapted to fit with the stepped rim of the access sub-assembly 11 as extended by the alignment ridge 81 of the intermediate sub-assembly 13, such that, when the intermediate sub-assembly 13 is inserted into the housing sub-assembly 12, the alignment ridge 81 fits against the inner rim 91 and, when all three of the access sub-assembly 11, the housing sub-assembly 12 and the intermediate sub-assembly 13 are assembled, the outer rims 76 and 92 fit against each other. The inner rim 91 further comprises one or more third guide members 82' adapted to fit with the third guide members 82 of the intermediate sub-assembly 13 so that the housing sub-assembly 12 can be easily correctly aligned with the intermediate sub-assembly 13.

Turning to FIG. 9B, this figure provides a view of the intermediate sub-assembly 13 attached to the housing sub-assembly 12. The housing sub-assembly 12 is made "transparent" for the view, as represented using dashed lines.

As shown in FIG. 9B, the heater sub-assembly support frame 223 and the electrical power source support frame 224 of this embodiment extend to the bottom end of the housing sub-assembly 12 or its vicinity. This enables the intermediate sub-assembly 13 to be attached to the housing sub-assembly 12 using only one point on each of the intermediate sub-assembly 13 and the housing sub-assembly 12. In this embodiment, the attachment means for attaching the intermediate sub-assembly 13 to the housing sub-assembly 12 is a fastening means that can be removed in order to detach the intermediate sub-assembly 13 from the housing sub-assembly 12 for maintenance or cleaning. In particular, in this embodiment, a screw is used as the fastening means. It should be noted that, in other embodiments, it may be that only one of the heater sub-assembly support frame 223 and the electrical power source support frame 224 extend to the bottom end of the housing sub-assembly 12 or its vicinity. Furthermore, in other embodiments, the attachment means may be a permanent connection using glue or a snap-fit connection, for example where the aerosol generation device is intended to be disposable and not intended to be extensively disassembled and maintained.

FIG. 9C provides a view of the combined intermediate sub-assembly 13 and housing sub-assembly 12 resulting from this method stage.

Referring now to FIGS. 10A to 10D, further optional elements of the aerosol generation device 1 are shown.

Figure 10A:
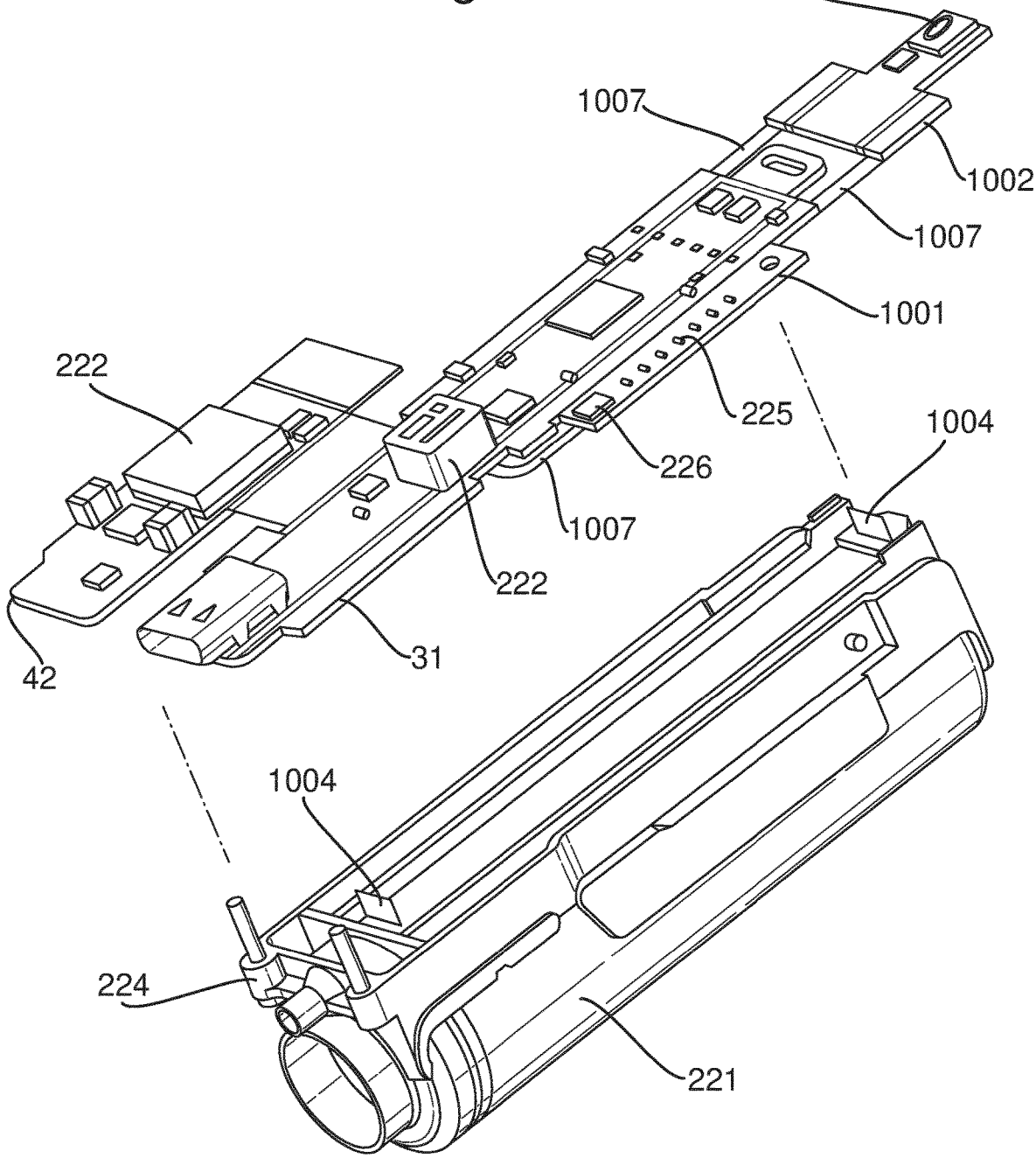
FIGS. 10A to 10D are schematic illustrations of further optional elements of the aerosol generation device.

As shown in FIG. 10A, the first PCB 31, second PCB 42 and flexible PCB portion 41 may be formed in a flat arrangement, such that an overall PCB structure including the control circuitry 222 on a plurality of PCBs can be manufactured as a single unit prior to assembly of the aerosol generation device 1. When this single unit is folded using the flexible PCB portion and arranged within the aerosol generation device 1, the control circuitry 222 takes up a smaller amount of space and improves the compactness of the aerosol generation device 1.

As further shown in FIG. 10A, the overall PCB structure may comprise a third PCB 1001 and/or a fourth PCB 1002, where all of the first to fourth PCBs are connected by one or more additional flexible PCB portions 1007. Alternatively, all of the PCBs may be connected together by a common flexible PCB portion.

Each of the PCBs in the overall PCB structure may be folded relative to the other PCBs in order to occupy a different plane from the other PCBs. For example, the second PCB 42 may, when arranged in the aerosol generation device 1, be parallel or perpendicular to the first PCB 31.

Figure 10B:
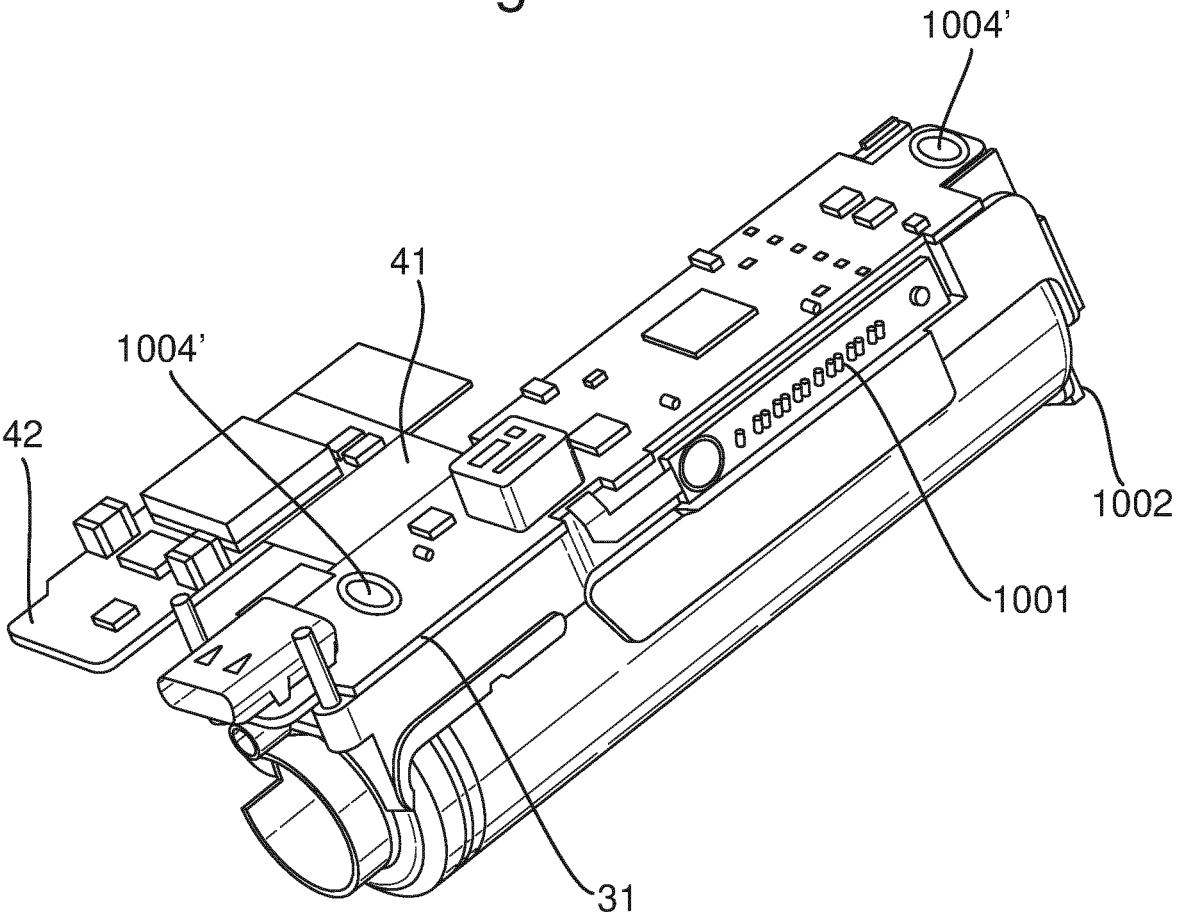

Additionally, in this embodiment, when the aerosol generation device 1 is assembled, the third PCB 1001 is arranged along the electrical power source support frame 224 (as part of the overall frame) as shown in FIG. 10B, and connected to the first PCB 31 by a flexible PCB portion, in order to provide the indicator array 225 and input(s) 226 adjacent to the central linear region 121 of the housing sub-assembly 12 as shown in FIGS. 1A and 2.

The fourth PCB 1002 may comprise control circuitry 1003 for a vibrator element 1005 of the vibrator sub-assembly 227.

The fourth PCB 1002 may additionally or alternatively comprise a movement sensor arranged to detect movement of the lid 111. The lid 111 or slider cart 73 may, for example, comprise a magnet (e.g. neodymium magnet) and the movement sensor may be a Hall effect sensor. This avoids the need to have a separate wired connection for a movement sensor in the aerosol generation device 1 and thereby simplifies the assembly process for the aerosol generation device 1 and reduces the length of wire required in the aerosol generation device 1.

Figure 10C:
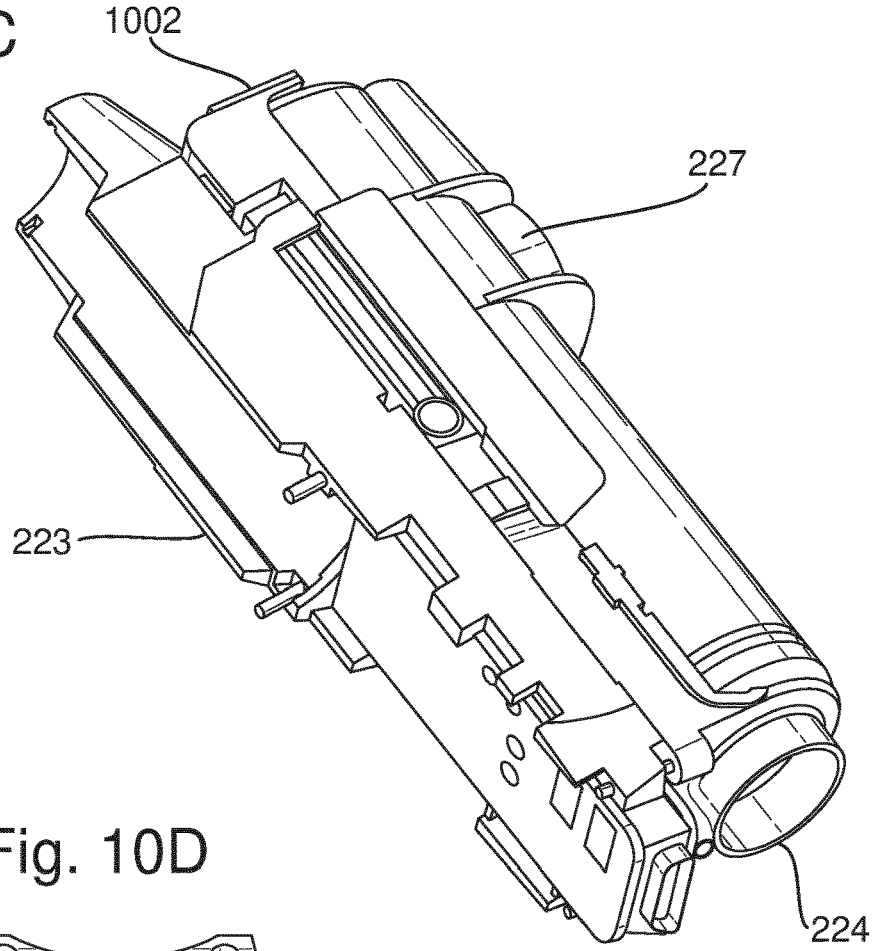
Figure 10D:
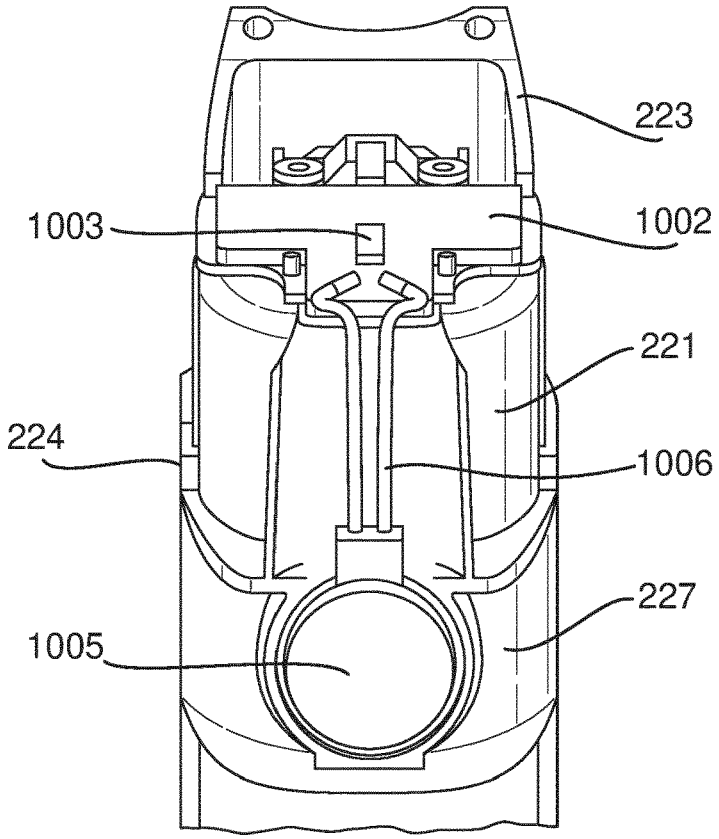

The fourth PCB 1002 may be arranged along the electrical power source support frame 224 (as part of the overall frame) as shown in FIGS. 10C and 10D, and connected to the first PCB 31 by a flexible PCB portion. The vibrator element 1005 may then be connected to the control circuitry 1003 or the fourth PCB 1002 via electrical connectors 1006 (e.g. wires which may be soldered to the fourth PCB 1002 and/or the vibrator element 1005). This makes it possible to additionally control the vibrator element 1005 while maintaining the compactness of the control circuitry 222 and 1003.

As further shown in FIGS. 10A and 10B, the electrical power source 221 may be provided with tags 1004 for making an electrical connection to the control circuitry 222. When assembling the aerosol generation device 1, these tags may be connected to contacts on the first PCB 31 using solder 1004'.

In other embodiments, either of the third and fourth PCBs may be omitted.

Definitions and Alternative Embodiments

It will be appreciated from the description above that many features of the described embodiment perform independent functions with independent benefits. Therefore the inclusion or omission of each of these independent features from embodiments of the invention defined in the claims can be independently chosen.

For example, in the above-described embodiment, a specific design of power-and-control sub-assembly 22 comprising multiple PCBs is used and is connected to heater sub-assembly 21 also having a very particular design. However, any power-and-control sub-assembly 22 could be connected to any heater sub-assembly 21 using the second guide members 33 and 35 as described above, thereby making easier the fixing of the heater sub-assembly 21 to the power-and-control sub-assembly 22.

The term "heater" should be understood to mean any device for outputting thermal energy sufficient to form an aerosol from the aerosol substrate. The transfer of heat energy from the heater 54 to the aerosol substrate may be conductive, convective, radiative or any combination of these means. As non-limiting examples, conductive heaters may directly contact and press the aerosol substrate, or they may contact a separate component such as the heating chamber which itself causes heating of the aerosol substrate by conduction, convection, and/or radiation.

Heaters may be electrically powered, powered by combustion, or by any other suitable means. Electrically powered heaters may include resistive track elements (optionally including insulating packaging), induction heating systems (e.g. including an electromagnet and high frequency oscillator), etc. The heater 54 may be arranged around the outside of the aerosol substrate, it may penetrate part way or fully into the aerosol substrate, or any combination of these. For example, instead of the heater of the above-described embodiment, an aerosol generation device may have a blade-type heater that extends into an aerosol substrate in the heating chamber.

The term "temperature sensor" is used to describe an element which is capable of determining an absolute or relative temperature of a part of the aerosol generation device 1. This can include thermocouples, thermopiles, thermistors and the like. The temperature sensor may be provided as part of another component, or it may be a separate component. In some examples, more than one temperature sensor may be provided, for example to monitor heating of different parts of the aerosol generation device 1, e.g. to determine thermal profiles. Alternatively, in some examples, no temperature sensor is included; for example, this would be possible where thermal profiles have already been reliably established and a temperature can be assumed based on operation of the heater 54.

The control circuitry 222 in the figures is shown as having a single user operable button to trigger the aerosol generation device 1 to turn on. This keeps the control simple and reduces the chances that a user will misuse the aerosol generation device 1 or fail to control the aerosol generation device 1 correctly. In some cases, however, the input controls available to a user may be more complex than this, for example to control the temperature, e.g. within pre-set limits, to change the flavour balance of the vapour, or to switch between power saving or quick heating modes, for example.

Aerosol substrate includes tobacco, for example in dried or cured form, in some cases with additional ingredients for flavouring or producing a smoother or otherwise more pleasurable experience. In some examples, the aerosol substrate such as tobacco may be treated with a vaporising agent. The vaporising agent may improve the generation of vapour from the aerosol substrate. The vaporising agent may include, for example, a polyol such as glycerol, or a glycol such as propylene glycol. In some cases, the aerosol substrate may contain no tobacco, or even no nicotine, but instead may contain naturally or artificially derived ingredients for flavouring, volatilisation, improving smoothness, and/or providing other pleasurable effects. The aerosol substrate may be provided as a solid or paste type material in shredded, pelletised, powdered, granulated, strip or sheet form, optionally a combination of these. Equally, the aerosol substrate may be a liquid or gel. Indeed, some examples may include both solid and liquid/gel parts.

Consequently, the aerosol generation device 1 could equally be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol substrate.

The aerosol generation device 1 may be arranged to receive the aerosol substrate in a pre-packaged substrate carrier. The substrate carrier may broadly resemble a cigarette, having a tubular region with an aerosol substrate arranged in a suitable manner. Filters, vapour collection regions, cooling regions, and other structure may also be included in some designs. An outer layer of paper or other flexible planar material such as foil may also be provided, for example to hold the aerosol substrate in place, to further the resemblance of a cigarette, etc. The substrate carrier may fit within the heating chamber 53 or may be longer than the heating chamber 53 such that the lid 111 remains open while the aerosol generation device 1 is provided with the substrate carrier. In such embodiments, the aerosol may be provided directly from the substrate carrier which acts as a mouthpiece for the aerosol generation device.

As used herein, the term "fluid" shall be construed as generically describing non-solid materials of the type that are capable of flowing, including, but not limited to, liquids, pastes, gels, powders and the like. "Fluidized materials" shall be construed accordingly as materials which are inherently, or have been modified to behave as, fluids. Fluidization may include, but is not limited to, powdering, dissolving in a solvent, gelling, thickening, thinning and the like.

As used herein, the term "volatile" means a substance capable of readily changing from the solid or liquid state to the gaseous state. As a non-limiting example, a volatile substance may be one which has a boiling or sublimation temperature close to room temperature at ambient pressure. Accordingly "volatilize" or "volatilise" shall be construed as meaning to render (a material) volatile and/or to cause to evaporate or disperse in vapour.

As used herein, the term "vapour" (or "vapor") means: (i) the form into which liquids are naturally converted by the action of a sufficient degree of heat; or (ii) particles of liquid/moisture that are suspended in the atmosphere and visible as clouds of steam/smoke; or (iii) a fluid that fills a space like a gas but, being below its critical temperature, can be liquefied by pressure alone.

Consistently with this definition the term "vaporise" (or "vaporize") means: (i) to change, or cause the change into vapour; and (ii) where the particles change physical state (i.e. from liquid or solid into the gaseous state).

As used herein, the term "atomise" (or "atomize") shall mean: (i) to turn (a substance, especially a liquid) into very small particles or droplets; and (ii) where the particles remain in the same physical state (liquid or solid) as they were prior to atomization.

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. A method for manufacturing an aerosol generation device, the method comprising:

forming an intermediate sub-assembly by fixing a heater sub-assembly against a power-and-control sub-assembly, the heater sub-assembly comprising a heater and a heating chamber, wherein the heater is arranged in the heater sub-assembly to supply heat to or in the heating chamber, and the power-and-control sub-assembly comprising an electrical power source and control circuitry configured to control a supply of electrical power from the electrical power source to the heater; and attaching a housing sub-assembly to the intermediate sub-assembly, the housing sub-assembly comprising a housing for at least a part of the intermediate sub-assembly.

2. The method according to claim 1, further comprising forming the power-and-control sub-assembly by:

aligning a heater sub-assembly support frame and an electrical power source support frame with a first PCB therebetween, the first PCB having a component of the control circuitry mounted thereon; and attaching the heater sub-assembly support frame to the electrical power source support frame.

3. The method according to claim 2, wherein:

the first PCB is connected to a second PCB by a flexible PCB portion, and forming the power-and-control sub-assembly further comprises wrapping the flexible PCB portion around the heater sub-assembly support frame and attaching the second PCB to the heater sub-assembly support frame such that the heater sub-assembly support frame is between the first PCB and the second PCB.

4. The method according to claim 2, wherein two or more of the heater sub-assembly support frame, the electrical power source support frame and the first PCB each comprise first guide members, and aligning the heater sub-assembly support frame and the electrical power source support frame with the first PCB therebetween comprises aligning the first guide members.

5. The method according to claim 1, further comprising forming the power-and-control sub-assembly using only snap-fit or press-fit mechanical connections.

6. The method according to claim 4, wherein the heater sub-assembly and the power-and-control sub-assembly each comprise second guide members, and fixing the heater sub-assembly against the power-and-control sub-assembly comprises aligning the second guide members.

7. The method according to claim 1, wherein fixing the heater sub-assembly against the power-and-control sub-assembly comprises attaching a mounting cap to one or both of the heater sub-assembly and the power-and-control sub-assembly, and wherein the heater sub-assembly, the power-and-control sub-assembly and the mounting cap are adapted to interlock with each other such that, when the mounting cap is attached to the one or both of the heater sub-assembly and the power-and control sub-assembly, the heater sub-assembly is fixed against the power-and-control sub-assembly.

8. The method according to claim 1, wherein attaching the housing sub-assembly to the intermediate sub-assembly consists only of using an attachment means to attach a point on the housing to a point on the intermediate sub-assembly.

9. The method according to claim 8, wherein the attachment means is a fastening means.

10. The method according to claim 1, wherein attaching the housing sub-assembly to the intermediate sub-assembly consists only of using is a screw to attach a point on the housing to a point on the intermediate sub-assembly.

11. The method according to claim 1, further comprising attaching an access sub-assembly to the intermediate sub-assembly, the access sub-assembly comprising means for opening and closing access to the heating chamber.

12. The method according to claim 1, further comprising attaching an access sub-assembly to the intermediate sub-assembly, wherein the access sub-assembly and the intermediate sub-assembly are adapted to form one or more snap-fit or press-fit connections with each other.

13. A sub-assembly for manufacturing an aerosol generation device, the sub-assembly comprising:

a heater sub-assembly fixed against a power-and-control sub-assembly, wherein the power-and-control sub-assembly comprises an electrical power source and control circuitry configured to control a supply of electrical power from the electrical power source to a heater, the heater sub-assembly comprises the heater and a heating chamber, and the heater is arranged in the heater sub-assembly to supply heat to or in the heating chamber, wherein the power-and-control sub-assembly further comprises a heater sub-assembly support frame attached to an electrical power source support frame with a first PCB therebetween, the first PCB having a component of the control circuitry mounted thereon, and wherein the first PCB is connected to a second PCB by a flexible PCB portion, the flexible PCB portion is wrapped around the heater sub-assembly support frame, and the second PCB is attached to the heater sub-assembly support frame such that the heater sub-assembly support frame is between the first PCB and the second PCB.

14. The sub-assembly according to claim 13, wherein the control circuitry comprises a PCB having exposed electrical contacts for testing and/or for connection to the heater sub-assembly.

15. The sub-assembly according to claim 13, further comprising a mounting cap attached to one or both of the heater sub-assembly and the power-and-control sub-assembly, wherein the heater sub-assembly, the power-and-control sub-assembly and the mounting cap are adapted to interlock with each other such that the heater sub-assembly is fixed against the power-and-control sub-assembly.

16. An aerosol generation device comprising the sub-assembly of claim 13 as an intermediate sub-assembly, and further comprising:

a housing sub-assembly comprising a housing for at least a part of the intermediate sub-assembly, wherein the housing sub-assembly is attached to the intermediate sub-assembly.

17. The aerosol generation device according to claim 16, further comprising an access sub-assembly comprising means for opening and closing access to the heating chamber, wherein the access sub-assembly is attached to the intermediate sub-assembly.

18. The aerosol generation device according to claim 17, further comprising a mounting cap attached to one or both of the heater sub-assembly and the power-and-control sub-assembly, wherein the heater sub-assembly, the power-and-control sub-assembly and the mounting cap are adapted to interlock with each other such that the heater sub-assembly is fixed against the power-and-control sub-assembly, wherein the access sub-assembly is only attached to the mounting cap.

19. An aerosol generation device comprising:

an intermediate sub-assembly comprising a heater sub-assembly fixed against a power-and-control sub-assembly, wherein the power-and-control sub-assembly comprises an electrical power source and control circuitry configured to control a supply of electrical power from the electrical power source to a heater, the heater sub-assembly comprises the heater and a heating chamber, and the heater is arranged in the heater sub-assembly to supply heat to or in the heating chamber;

a housing sub-assembly comprising a housing for at least a part of the intermediate sub-assembly, wherein the housing sub-assembly is attached to the intermediate sub-assembly;

an access sub-assembly comprising means for opening and closing access to the heating chamber, wherein the access sub-assembly is attached to the intermediate sub-assembly; and a mounting cap attached to one or both of the heater sub-assembly and the power-and-control sub-assembly, wherein the heater sub-assembly, the power-and-control sub-assembly and the mounting cap are adapted to interlock with each other such that the heater sub-assembly is fixed against the power-and-control sub-assembly, wherein the access sub-assembly is only attached to the mounting cap.

* * * * *